US011358269B2

(12) United States Patent
Ngo

(10) Patent No.: US 11,358,269 B2
(45) Date of Patent: Jun. 14, 2022

(54) TORQUE ENHANCING ADAPTER FOR A HAND TOOL

(71) Applicant: Raytheon Company, Waltham, MA (US)

(72) Inventor: Alan Ngo, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 303 days.

(21) Appl. No.: 16/588,999

(22) Filed: Sep. 30, 2019

(65) Prior Publication Data

US 2021/0094165 A1 Apr. 1, 2021

(51) Int. Cl.

| | |
|---|---|
| ***B25G 1/00*** | (2006.01) |
| ***B25B 23/00*** | (2006.01) |
| ***B25B 23/16*** | (2006.01) |

(52) U.S. Cl.

CPC ..... *B25G 1/005* (2013.01); *B25B 23/0007* (2013.01); *B25B 23/16* (2013.01)

(58) Field of Classification Search

CPC ..... B25G 1/005; B25B 23/0007; B25B 23/16
USPC ..... 81/64, 177.5, 125.1
See application file for complete search history.

(56) References Cited

U.S. PATENT DOCUMENTS 226,582 A * 4/1880 Miller ..... B25B 13/06 81/124.4
606,587 A * 6/1898 Schairer ..... B67B 7/18 81/3.4
1,140,947 A * 5/1915 Butler ..... B25B 13/102 81/185
1,281,438 A * 10/1918 Tuttle ..... B25B 13/102 81/124.5
2,571,570 A 10/1951 Hagar
2,725,086 A * 11/1955 Keyes ..... B25G 1/005 81/15.9
3,072,955 A 1/1963 Mitchell
3,752,202 A 8/1973 Condon
4,000,767 A 1/1977 Geng
4,393,539 A 7/1983 Weissman
4,699,020 A 10/1987 Bush et al.

(Continued)

FOREIGN PATENT DOCUMENTS

DE 3740466 A1 6/1989
EP 0084676 A2 8/1983

OTHER PUBLICATIONS

International Search Report for International Application No. PCT/US2020/044350 dated Nov. 12, 2020, 14 pages.

*Primary Examiner* — Hadi Shakeri

(57) ABSTRACT

A hand tool system comprises a first driver, a second driver, and a driver adapter. The first driver and the second driver each comprises a driver handle having an external configuration and a driver component secured to the driver handle. The driver adapter is selectively fittable over the driver handles of the first and second drivers. The driver adapter comprises an elongate body, a first socket formed in a first end of the elongate body, a second socket formed in a second end of the elongate body, and a plurality of through holes formed through and distributed longitudinally along a length of the elongate body. Each socket has an internal configuration sized and shaped to receive a driver handle of either the first or second driver and to transfer torque to the driver upon rotation of the driver adapter.

25 Claims, 15 Drawing Sheets

(56) References Cited

U.S. PATENT DOCUMENTS

| | | | | |
|---|---|---|---|---|
| 5,086,674 | A * | 2/1992 | Her | B25B 13/06 7/138 |
| 5,860,190 | A | 1/1999 | Cano | |
| 6,922,870 | B2 | 8/2005 | Tontz, Sr. | |
| 8,307,742 | B2 * | 11/2012 | Hsu | B25B 13/56 81/124.4 |
| 9,193,058 | B2 | 11/2015 | Gallegos | |
| 9,573,256 | B2 | 2/2017 | Hsieh | |
| 2004/0099102 | A1 * | 5/2004 | Vaughan | B25G 1/066 81/124.4 |
| 2005/0160882 | A1 * | 7/2005 | Crow | B25B 13/06 81/177.2 |
| 2016/0236335 | A1 | 8/2016 | Hsieh | |
| 2017/0157749 | A1 | 6/2017 | Levy | |
| 2017/0305008 | A1 | 10/2017 | Wang | |

* cited by examiner

TORQUE ENHANCING ADAPTER FOR A HAND TOOL

BACKGROUND

Hand held drivers, such as screwdrivers, are commonly used to torque fasteners and fastener components, such as various types of screws, bolts, nuts, and others. In one example, a hand held driver can have a driver shaft with one end configured as a driver head to interface with and engage an interface portion of a head of a fastener. The hand held driver can further comprise a handle in support of the driver shaft, and configured to be grasped by a user, such that the user is able to manually apply the needed or desired torque to the fastener or fastener component via the hand held driver. There are a variety of different types and configurations of hand held drivers, including, but not limited to, flat and Phillips drivers, nut drivers, star drivers, and hex key drivers. In addition to differing driver types and configurations, there are a variety of sizes of drivers. As such, a wide range of hand held drivers are available to interface with the various types and sizes and configurations of available fasteners.

The relative size of a driver handle is often related to the size of the driver and the application in which the driver will be used. Larger drivers with larger handles are often used in areas with adequate space, while smaller drivers are often used in areas with less space, requiring a smaller handle size.

An operator's daily use of high torque drivers can result in arm, wrist and/or hand pain. An operator using a driver to fasten a fastener for whatever purpose, such as assembling machinery or joining component parts, may be required to torque a fastener a pre-determined amount. Some hand held torque drivers can provide operators with an indication of the amount of torque applied to a fastener, thus notifying the operator when to stop tightening the fastener. Such hand held torque drivers typically need to be calibrated to ensure that the torque settings are accurate and that fasteners used with such drivers are being torqued properly. The process of calibrating a torque driver often calls for a technician to insert the driver shaft into a calibration tool and torque the tool throughout a range of torques. This calibration process may require a technician to repeatedly torque multiple drivers in the calibration tool on a daily basis. Moreover, there are many instances that require individuals to repeatedly use hand held drivers, such as to complete various tasks or to perform their jobs (e.g., assembly line workers, and others). Such repeated hand and wrist motions by any individuals using hand held drivers, particularly over time (e.g., hours, days, weeks, months, or even years) can result in injury. Minor injuries to ligaments, muscles or tendons in the arms, wrist, and/or hand can include fatigue, soreness or swelling. More significant injuries to ligaments, muscles or tendons in the arms, wrist, and/or hand can include sprains or more lasting strains. Major injuries can involve the nerves, where certain repeated motions by an individual can result in carpal tunnel syndrome, osteoarthritis, and tendonitis.

BRIEF DESCRIPTION OF THE DRAWINGS

Features and advantages of the invention will be apparent from the detailed description which follows, taken in conjunction with the accompanying drawings, which together illustrate, by way of example, features of the invention, wherein.

Figure 1:
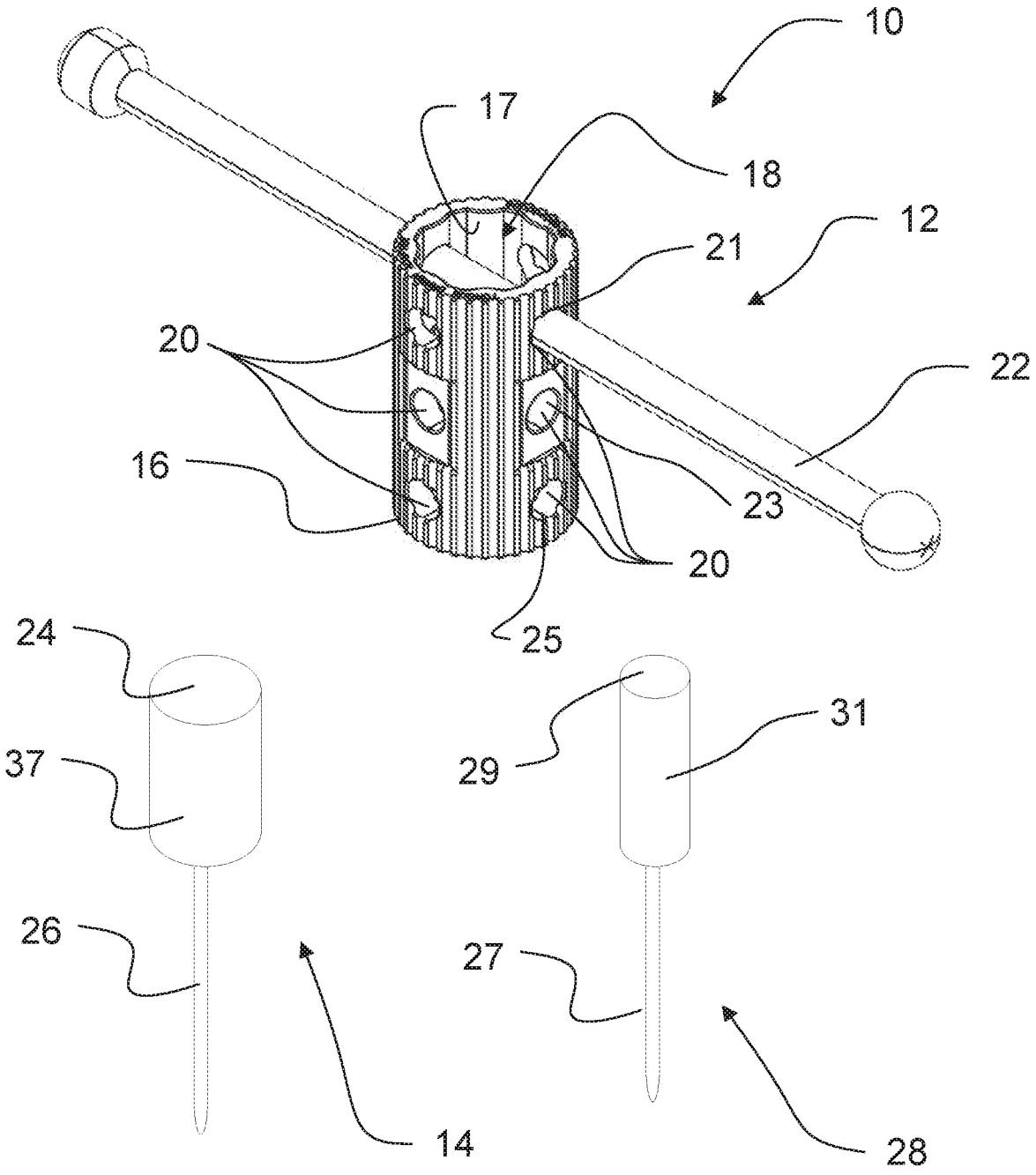
FIG. 1 illustrates an isometric view of a hand tool system showing a driver adapter having three sockets configured to be operable with three different hand tool drivers, two of which are shown, in accordance with an example of the present disclosure.

Reference will now be made to the examples illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "through hole" is a hole or opening that is made to go completely through the wall or walls of the elongate body of the driver adapter, A "through hole" can comprise a single hole or opening, or a series of holes or openings passing through multiple walls of the driver adapter along a common axis. For example, the torque lever disclosed herein can comprise a linear rod that passes through a first opening or hole in the elongate body of the driver adapter at one location (e.g., on one side), and that passes through a second hole or opening in the elongate body of the driver adapter at another location (e.g., on an opposing side). Of course, the torque adapter can comprise other designs or configurations passing through any number of "through holes" along any axis or series of axes.

An initial overview of the inventive concepts are provided below and then specific examples are described in further detail later. This initial summary is intended to aid readers in understanding the examples more quickly, but is not intended to identify key features or essential features of the examples, nor is it intended to limit the scope of the claimed subject matter.

In one example, disclosed is a driver adapter comprising an elongate body, a first socket, a second socket, and a plurality of through holes in the elongate body. The driver adapter is for use with a driver handle of a driver and is operable to transfer torque to the driver. The elongate body has a first end and a second end spaced longitudinally apart from the first end. The first socket is formed in the first end and has an internal configuration sized and shaped to receive a driver handle of a first driver and to transfer torque to the first driver upon rotation of the driver adapter. The second socket is formed in the second end and has an internal configuration sized and shaped to receive a driver handle of a second driver and transfer torque to the second driver upon rotation of the driver adapter. The plurality of through holes are formed through and distributed longitudinally along a length of the elongate body between the first end and the second end. The plurality of through holes sized and configured to receive a torque lever that facilitates rotation of the driver adapter.

In accordance with a more detailed aspect, the first socket can be different in size from the second socket, such that the driver adapter is operable with the first and second drivers having driver handles of different size.

In accordance with a more detailed aspect, the internal configuration of the first socket can be different from the internal configuration of the second socket, such that the driver is operable with the first and second drivers being of different types, and having driver handles of different configuration.

In accordance with a more detailed aspect, the internal configuration of the first socket can have a first pattern of first protrusions and the internal configuration of the second socket can have a second pattern of second protrusions.

In accordance with a more detailed aspect, the internal configuration of the first socket can have a first pattern of flats and the internal configuration of the second socket can have a second pattern of flats.

In accordance with a more detailed aspect, the internal configuration of the first socket can have a pattern of flats and the internal configuration of the second socket can have a pattern of protrusions.

In accordance with a more detailed aspect, at least one of the first pattern of protrusions or the second pattern of protrusions can be sized and shaped to complement a flute of a driver handle.

In accordance with a more detailed aspect, a minor diameter of the internal configuration of the first socket can be greater than a major diameter of the internal configuration of the second socket.

In accordance with a more detailed aspect, the driver adapter can further comprise a third socket formed in the elongate body between the first and second sockets. The third socket can have a third configuration sized and shaped to receive a driver handle of a third driver.

In accordance with a more detailed aspect, the third socket can comprise a major diameter less than a minor diameter of the first configuration of the first socket and a minor diameter of the second configuration of the second socket.

In accordance with a more detailed aspect, the driver adapter can further comprise a torque lever extending through a through hole of the plurality of through holes.

In accordance with a more detailed aspect, the torque lever can comprise a rigid rod.

In accordance with a more detailed aspect, the rigid rod can extend through a through hole of the plurality of through holes, such that the rigid rod extends in opposing directions from the driver adapter.

In accordance with a more detailed aspect, the torque lever can comprise a flexible strap extending through a through hole of the plurality of through holes and a rigid handle coupled to the flexible strap, wherein, via the rigid handle, the flexible strap can be tightened around the driver handle and the rigid handle rotated to apply torque to the driver via the driver adapter.

Also disclosed is a hand tool system comprising a first driver, a second driver, and a driver adapter. The first driver comprises a driver handle having a first external configuration and a driver component secured to the driver handle. The second driver comprises a driver handle having a second external configuration and a driver component secured to the driver handle. The driver adapter is selectively fittable over the driver handles of the first and second drivers. The driver adapter comprises an elongate body having a longitudinal axis, a first end, and a second end spaced longitudinally apart from the first end. A first socket is formed in the first end with the first socket having an internal configuration of the first socket sized and shaped to receive the driver handle of the first driver and transfer torque to the first driver upon rotation of the driver adapter. A second socket is formed in the second end. The second socket has an internal configuration sized and shaped to receive the driver handle of the second driver and transfer torque to the second driver upon rotation of the driver adapter. A plurality of through holes are formed through and distributed longitudinally along a length of the elongate body between the first end and the second end. The plurality of through holes are sized and configured to receive a torque lever that facilitates rotation of the driver adapter.

In accordance with a more detailed aspect, the driver adapter can further comprise a torque lever disposed in a hole of the plurality of through holes.

In accordance with a more detailed aspect, the first external configuration of the driver handle of the first driver can have a plurality of flutes, and the internal configuration of the first socket of the driver adapter can have a plurality of protrusions configured to extend into the plurality of flutes.

In accordance with a more detailed aspect, the first external configuration of the driver handle of the first driver can have a first plurality of flats, and the internal configuration of the first socket of the driver adapter can have a second plurality of flats configured to interface with the first plurality of flats.

In accordance with a more detailed aspect, the torque lever can comprise a flexible strap extending through a through hole of the plurality of through holes and a rigid handle coupled to the flexible strap.

In accordance with a more detailed aspect, the hand tool system can further comprise a second driver comprising a driver handle having a second external configuration and a driver component secured to the driver handle. The driver adapter can be further selectively fittable over the driver handles of the third driver and the driver adapter can further comprise a third socket. The third socket can have an internal configuration sized and shaped to receive the driver handle of the third driver and transfer torque to the third driver upon rotation of the driver adapter.

In accordance with a more detailed aspect, the first socket can be different in size from the second socket, such that the driver adapter is operable with the first and second drivers having driver handles of different size.

In accordance with a more detailed aspect, the internal configuration of the first socket can be different from the internal configuration of the second socket, such that the driver is operable with the first and second drivers being of different types, and having driver handles of different configuration.

Also disclosed is a method for configuring a driver adapter. The method comprises forming a first socket in a first end of an elongate body, forming a second socket in a second end of the elongate body spaced longitudinally from the first end, and forming a plurality of through holes formed through and distributed longitudinally along a length of the elongate body between the first end and the second end. The first socket has an internal configuration sized and shaped to fit a handle of a first driver and to transfer torque to the first driver upon rotation of the driver adapter. The second socket has an internal configuration sized and shaped to fit a handle of a second driver. The plurality of through holes are sized and configured to receive a torque lever that facilitates rotation of the driver adapter.

In accordance with a more detailed aspect, the method can further comprise forming the internal configuration of the first socket with a first pattern of protrusions, and forming the internal configuration of the second socket with a second pattern of protrusions.

In accordance with a more detailed aspect, the method can further comprise forming at least one of the first pattern of protrusions and the second pattern of protrusions with a size and shape to complement a flute of a driver handle.

In accordance with a more detailed aspect, the method can further comprise forming the first socket to have a minor diameter of the first internal configuration greater than a minor diameter of the second internal configuration.

In accordance with a more detailed aspect, the method can further comprise forming a third socket between the first socket and the second socket. The third socket can have a third configuration sized and shaped to receive a driver handle of a third driver, and can have a major diameter less than a minor diameter of the first configuration and a minor diameter of the second configuration.

FIG. 1 illustrates a hand held tool system 10 in accordance with an example of the present disclosure. The hand held tool system 10 comprises a driver adapter 12, a first driver 14 (e.g., a screwdriver or other hand tool for interfacing with and driving/torqueing fasteners), and a second driver 28. The driver adapter 12 comprises an elongate body 16, a longitudinal bore 18 formed in the driver adapter 12 having a lateral surface 17 defining at least two sockets and a plurality of through holes 20. The driver adapter 12 can further include a torque lever 22 that interfaces with the plurality of through holes 20. The first and second drivers 14, 28 each comprise a driver handle (e.g., see first driver handle 24 of first driver 14, and second driver handle 29 of second driver 28) and a driver component (e.g., see first driver component 26 of the first driver 14, and second driver component 27 of second driver 28) secured to the driver handle. As will be shown in subsequent figures, the at least two sockets each comprise an internal configuration sized and shaped to receive the driver handle of a driver (e.g., one of the first and second drivers 14, 28) and transmit torque from the driver adapter 12 to the driver handle and the driver upon rotation of the driver adapter 12, which torque is transmitted to a fastener.

The torque lever 22 can be a rigid rod that extends through a through hole of the plurality of through holes 20. The torque lever 22 can extend in opposing directions from the driver adapter 12. An operator can remove the torque lever 22 from a first through hole 21 and insert the torque lever 22 into a second through hole as needed. For example, with the hand tool system 10 shown in FIG. 1, the torque lever 22 may interfere with the first driver handle 24 in the first through hole 21. The operator can remove the torque lever 22 from the first through hole 21 and insert the torque lever 22 in a different through hole such as through hole 23 or through hole 25 if the upper socket is needed. In other examples, an operator may utilize the driver adapter 12 without the torque lever 22 in any of the plurality of through holes 20.

In use, the operator may use the hand held tool system 10 to reduce the force needed to produce a given torque by increasing the leverage arm (i.e., moment arm) for the operator. For example, an operator may position the driver adapter 12 over the first driver handle 24 of the first driver 14, with the first driver handle 24 being received within the first socket 40, and apply a rotational force to the driver adapter 12 to turn the first driver handle 24 and the first driver 14. Because the exterior surface of the driver adapter 12 has a greater distance from an axis of rotation of the first driver 14 than an exterior surface of the first driver handle 24, and because the point of application of force from the operator is located at the outer surface of the driver adapter 12, the same amount of force that would otherwise be applied to the driver without the driver adapter 12 will result in a greater torque when applied to the first driver 14 via the driver adapter 12. Another way of stating this is that, using the driver adapter 12, an operator can exert less force to achieve the same torque output than that which would be required by the operator without using the driver adapter 12. Moreover, when the operator utilizes the torque lever 22 to apply a force to the first driver 14, the amount of torque can be further increased with the same application of force input by the operator due to the even greater increased distance between the point of application of the force by the operator and the rotation axis of the first driver 14, again, as compared to the torque applied by the operator directly to the first driver 14 without the driver adapter 12.

As indicated above, the driver adapter 12 comprises at least two sockets configured different from one another. Thus, with respect to the second driver 28 having a second driver handle 29 of different size or shape from that of the first driver 14, the operator can invert the driver adapter 12 or otherwise reposition the driver adapter 12 to present the second socket of the at least two sockets that has an internal configuration sized and shaped to receive and accommodate the second driver handle 29 of the second driver 28.

The driver adapter 12 benefits an operator by reducing the amount of force required to produce a needed amount of torque relative to the first driver 14 alone. Furthermore, the driver adapter 12 can change the grip of an operator to a more comfortable position by providing a more ergonomic user interface that reduces arm, wrist and hand fatigue and the potential for injury. Indeed, because driver adapter 12 requires less force and an operator can use a more comfortable hand positioning to generate the same amount of needed torque compared to the first driver handle 24 alone, driver adapter 12 reduces the stress an operator experiences during torqueing operations. The reduction in stress allows an operator to perform more torqueing operations, or to perform repeated torqueing operations over time. Furthermore, by having at least two sockets, driver adapter 12 can be used on multiple sizes and shapes of driver handles without requiring additional tools. Thus, an operator can use a first socket of the driver adapter 12 to perform a first torqueing operation with a first driver and a second socket of the driver adapter 12 to perform a second torqueing operation with a second driver without requiring the operator to obtain a second driver adapter.

Figure 2:
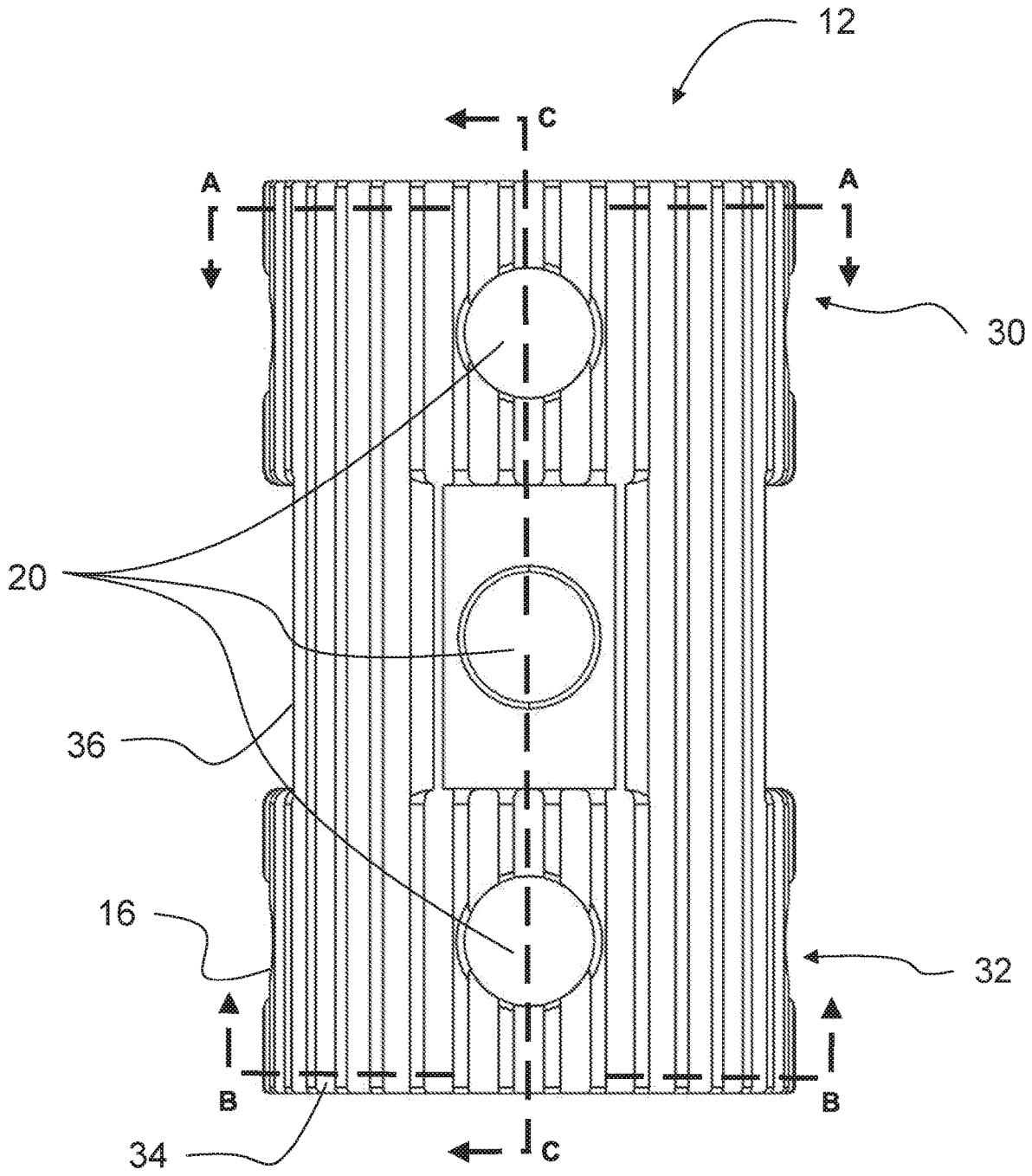
FIG. 2 illustrates a side view of the driver adapter component of the hand tool system of FIG. 1.

FIG. 2 shows a side view of the driver adapter 12 suitable for use with the first driver 14 and the second driver 28 of the hand held tool system 10 of FIG. 1. The driver adapter 12 comprises an elongate body 16 having a first end 30 and a second end 32 spaced longitudinally apart from the first end 30. A plurality of through holes 20 are formed through the elongate body 16 and are distributed longitudinally along a length of the elongate body 16. The elongate body 16 can comprise an outer surface configured to facilitate an improved grip of the operator over a smooth surface. In one example, the outer surface of the elongate body 16 can comprise a pattern of flutes 34, as shown in FIG. 2. The pattern of flutes 34 can be configured to assist an operator in gripping the driver adapter 12 when not using the torque lever 22 and to reduce slippage of the operator's hand during torqueing operations. Other non-smooth surface configurations are possible and contemplated herein, such as a textured surface, or any other surface configuration providing various protrusions and spaces between the protrusions. The elongate body 16 can further comprise at least one pair of flats 36 formed in the outer surface of the elongate body on opposing parallel planes. The at least one pair of flats 36 can provide a wrenching surface configured to interface with and receive a wrench, wherein the wrench can function as a torque lever similar to the torque lever 22.

The plurality of through holes 20 can be sized and configured to receive a torque lever that functions to provide a significant mechanical advantage in performing a torqueing operation using the driver adapter 12. In one example, the torque lever can be configured as torque lever 22 comprising a rigid rod. The rigid rod can comprise any cross-sectional configuration or shape (taken laterally through the rigid rod), such as a round cross-section. In addition, the plurality of through holes 20 can comprise a matching configuration or shape, and can be sized large enough to receive the torque lever 22, and to permit the torque lever 22 to pass through the through holes 20. Alternatively, the through holes 20 can comprise a shape or configuration different from the cross-sectional shape or configuration of the torque lever 22. In this case, the through holes 20 can be sized to have a minor distance (the minor distance defining the shortest distance between opposing walls of the elongate body 16 defining the through holes 20) (e.g., a minor diameter in the event the holes are circular) larger than the largest or major distance between opposing sides of the torque lever 22 (e.g., the diameter of the torque lever 22 in the event the torque lever comprises a circular cross-sectional area). In other examples, the torque lever 22 can comprise a cross-sectional shape other than a circle, such as a square, hexagon, and others. In such examples, the plurality of through holes 20 can have a similar shape, or can be sized sufficiently large to receive the torque lever 22 no matter its cross-sectional shape. The plurality of through holes 20 can be spaced apart from one another and located anywhere along the elongate body 16. As in the example shown, which is not intended to be limiting in any way, the through holes 20 can be spaced apart evenly from one another between the first end 30 and the second end 32, respectively, and oriented along a common longitudinal axis, thus providing different locations for the torque lever 22 to engage and to pass through the elongate body 16.

Figure 3:
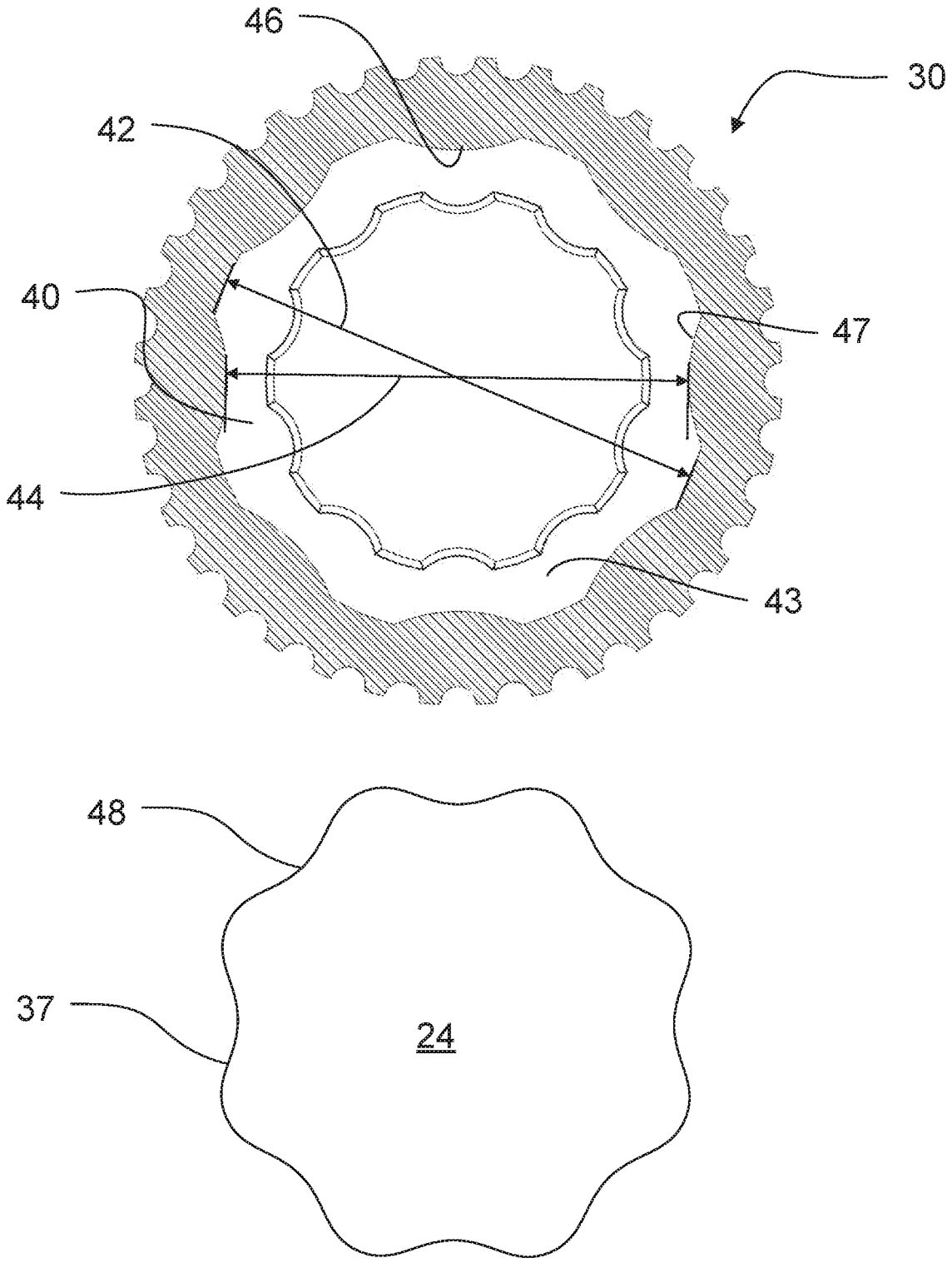
FIG. 3 illustrates a cross-sectional view of a first end of the driver adapter of FIG. 2 taken along line AA of FIG. 2, and a cross-sectional profile of a driver handle of a first driver of the hand tool system of FIG. 1 operable with the first socket.

FIG. 3 illustrates a cross section of the elongate body 16 viewed from the first end 30 of the driver adapter 12, FIG. 3 further illustrates an end view of the first driver handle 24 showing a profile of the first driver handle 24. With reference to FIGS. 1-3, and as in the example shown, the driver adapter 12 can comprise a first socket 40 formed in the first end 30 of the elongate body 16. The first socket 40 can have an internal configuration sized and shaped to receive at least a portion of the first driver handle 24, and to facilitate the transfer of torque to the first driver handle 24, and ultimately to the fastener (not shown) being driven. The first socket 40 can comprise an internal configuration having a major diameter 42 defined by the maximum width of the first socket 40 and a minor diameter 44 defined by the minimum width of the first socket 40. In one example, such as shown in FIG. 3, the first socket 40 can comprise a pattern of protrusions 46 extending inward from the major diameter 42 to define the minor diameter 44. The first socket 40 can comprise any number of protrusions. For example, the first socket 40 can comprise a plurality of protrusions (with the example first socket 40 shown in FIG. 3 comprising eight protrusions extending inward). Protrusions 46 can be configured and caused to be received into corresponding flutes 48 of the first driver handle 24 when the first driver handle 24 is inserted into the first socket 40. For example, the profile of the first driver handle 24 is shown as comprising eight flutes 48 sized and configured to receive, at least in part, the protrusions 46 of the driver adapter 12. In some examples, the protrusions 46 of the first socket 40 can be configured to mirror the flutes 48 of the first driver handle 24, such that a lateral surface 47 of first socket 40 mates with a lateral surface 37 of the first driver handle 24. However, this is not necessary. Indeed, there may be other examples in which the protrusions 46 of the first socket 40 (and any valleys or depressions) do not necessarily match or mate with the protrusions and/or valleys or depressions formed in the driver handle, but that nonetheless provide contact between protrusions 46 of the first socket 40 and protrusions of the driver handle 24, such as upon rotation in both the clockwise and counterclockwise directions.

Thus, when the driver adapter 12 is rotated with driver handle 24 positioned with first socket 40, the protrusions 46 can contact various lateral surface(s) 37 of the first driver handle 24 at various points (e.g., at at least three points) to transfer a force in a direction along an axis parallel to a tangential axis relative to a surface of the driver adapter 12 or the driver handle 24, which force can be transferred to the first driver handle 24. Rotation of the driver adapter 12 in either a clockwise or a counter clockwise direction will result in the first driver handle 24 rotating in the same direction as the driver adapter 12 as torque is transferred from the driver adapter 12 to the first driver handle 24 at the points of contact of the tangential force.

Figure 4:
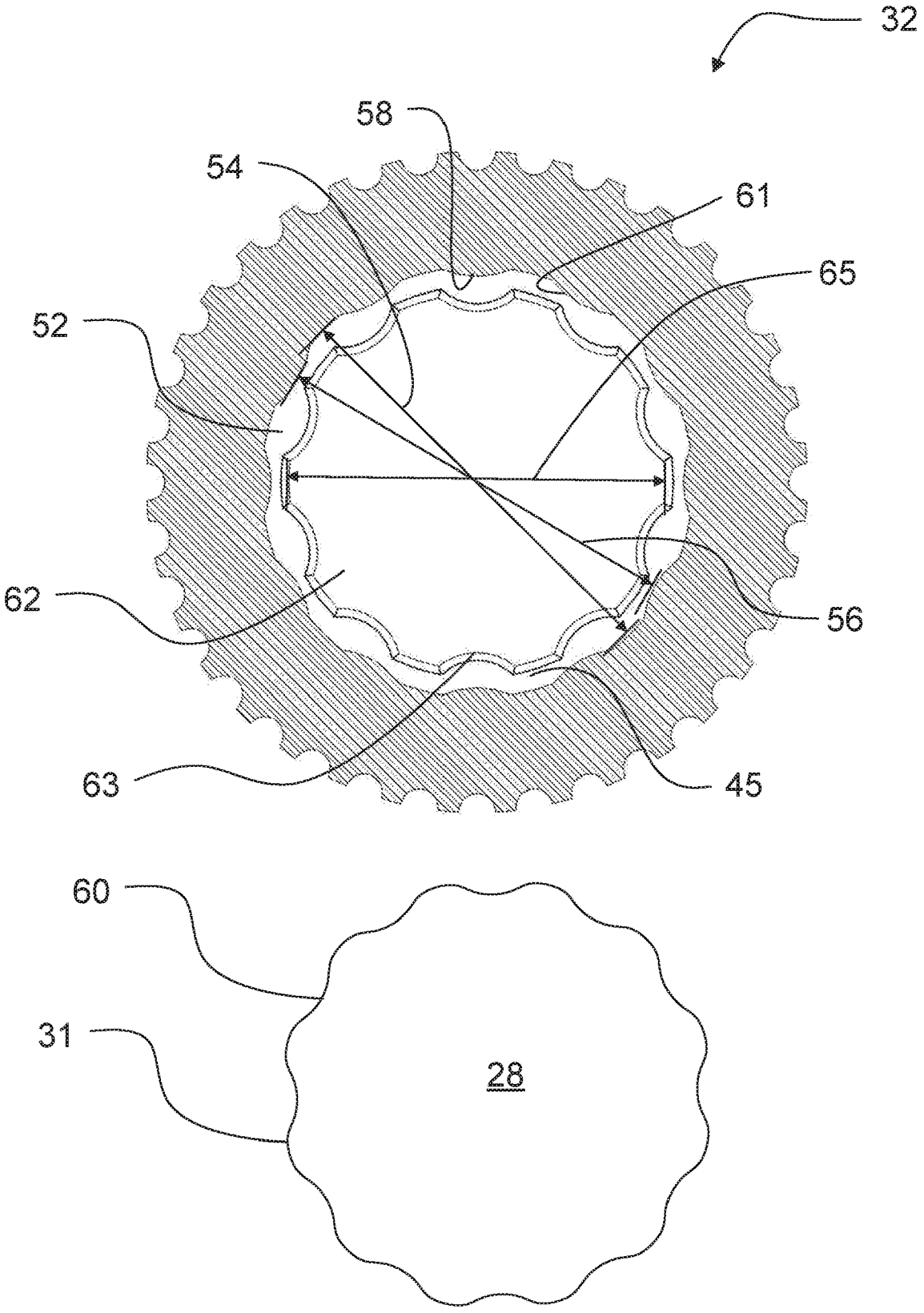
FIG. 4 illustrates a cross-sectional view of a second end and second socket of the driver adapter of FIG. 2 taken along line BB of FIG. 2, and a cross-sectional profile of a driver handle of a second driver of the hand tool system of FIG. 1 operable with the second socket.

FIG. 4 illustrates a cross section of the elongate body 16 viewed from the second end 32 of the driver adapter 12. FIG. 4 further illustrates an end view of the second driver handle 29 showing a profile 51 of the driver handle. With reference to FIGS. 1-4, and as in the example shown, the driver adapter 12 can comprise a second socket 52 formed in the second end 32 of the elongate body 16. The second socket 52 can have a lateral surface 61 defining an internal configuration sized and shaped to receive a portion of the second driver handle 29 of the second driver 28, and to facilitate the transfer of torque to the second driver handle 29 and the second driver 28, and ultimately to a fastener (not shown) being driven. The second socket 52 can comprise an internal configuration with a major diameter 54 defined by the maximum width of the socket and a minor diameter 56 defined by the minimum width of the socket. In some examples, the minor diameter 44 of the first socket 40 may be greater than the major diameter 54 of the second socket. In one example, such as shown in FIG. 4, the second socket 52 can have a pattern of protrusions 58 extending inward from the major diameter 54 to define the minor diameter 56. The second socket can comprise any number of protrusions. For example, the second socket can comprise a plurality of protrusions (with the example second socket shown in FIG. 4 comprising twelve protrusions 58 extending inwards). The protrusions 58 can be configured and caused to be received into corresponding flutes 60 of the second driver handle 29 when the second driver handle 29 is inserted into the second socket 52 to provide or facilitate contact with the driver handle 29 to effectuate the transfer of torque from the driver adapter 12 to the driver handle 29. In the example of FIG. 4, there are twelve flutes 60 for the protrusions 58 to extend into.

Thus, when the driver adapter 12 is rotated with second driver handle 29 positioned within second socket 52, the protrusions 58 can contact the lateral surface 31 of the second driver handle 29 at at least three points transferring a tangential force from the driver adapter 12 to the second driver handle 29. Rotation of the driver adapter 12 in either a clockwise or a counter clockwise direction will result in the second driver handle 29 rotating in the same direction as the driver adapter 12 as torque is transferred from the driver adapter 12 to the second driver handle 29 at the point of contact of the tangential force.

A third socket 62 can be formed in the elongate body 16 between the first socket 40 and the second socket 52. The third socket 62 can have an internal configuration sized and shaped to receive a portion of a third driver handle of a third driver (not shown, but similar to the first and second drivers, only smaller in this case), and to facilitate the transfer of torque to the third driver handle. The third socket 62 can comprise an internal configuration having a major diameter 65 defined by that largest width of the socket and a minor diameter defined by the minimum width of the third socket. The major diameter 65 can be less than the minor diameter 44 of the first socket 40 and the minor diameter 56 of the second socket to define a first shoulder 43 (shown in FIG. 3) between the first socket and the third socket and a second shoulder 45 between the second socket and the third socket. As shown in FIGS. 3 and 4, the third socket 62 can extend from the first socket 40 to the second socket 52 so that the third socket 62 is accessible from both the first end 30 and the second end 32. Although the internal configuration of the third socket can have any shape suitable for interfacing with a driver, in the example of FIG. 4, the third socket 62 has ten protrusions 63 which can extend into corresponding flutes of a third driver handle.

In use, the driver adapter 12 can be positioned over the third driver handle with the third driver handle passing through either the first socket 40 or the second socket 52 and into the third socket 62. The third socket 62 is similar in many respects to the first socket 40 and the second socket 52 discussed above and can function in a similar manner. As such, the discussion above is incorporated here where applicable with an understanding that third socket 62 differs from the first and second socket in its internal size or configuration (or both) and its location. As a user rotates the driver adapter 12, the protrusions 63 can contact a lateral surface of the driver handle transferring a force from the driver adapter 12 to the third driver handle. Rotation of the driver adapter 12 in either a clockwise or a counter clockwise direction will result in the third driver handle rotating in the same direction as the driver adapter 12 as torque is transferred from the driver adapter 12 to the third driver handle at the point of contact of the tangential force.

Figure 5:
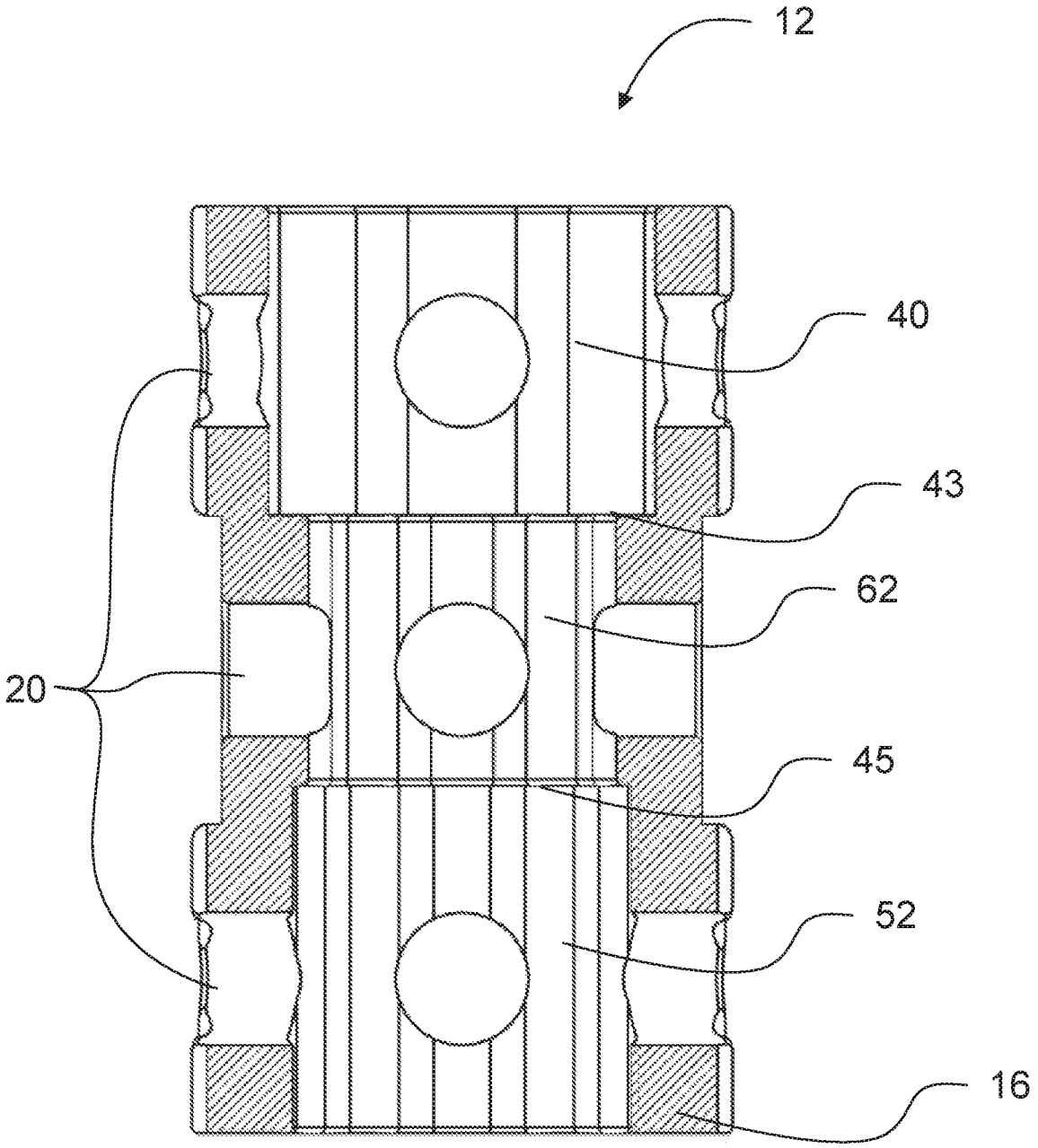
FIG. 5 illustrates a cross-sectional view of the driver adapter of FIG. 2, taken along line CC of FIG. 2, showing all three sockets.

FIG. 5 illustrates the third socket 62 being positioned between the first socket 40 and the second socket 52. Additionally, through holes 20 extend through the elongate body 16 and can extend through the first, second, and third sockets 40, 52, and 62, respectively. For example, when a socket of the driver adapter 12 is placed over a driver handle, the driver handle may block a through hole 20 so that a torque lever is unable to be inserted through a particular through hole 20 associated with that socket. For example, upon insertion of a driver handle into the second socket 52, then the through hole 20 extending along an axis through and associated with the second socket 52 may be blocked. In such instances, the through hole 20 extending along an axis through and associated with the first socket 40 remains unblocked and a torque lever (e.g., torque lever 22 shown in FIG. 1) can be inserted through the upper through hole 20 instead. Upon insertion of a driver handle into the first socket 40, then the through hole 20 associated with the first socket 40 may be blocked. However, the through hole 20 associated with the second socket 52 is now open and the torque lever 22 may be inserted at that location. Upon insertion of a driver handle into the third socket 62 (from either the first end 30 or the second end 32), and depending upon the orientation of the driver adapter 12, and specifically which end of the driver adapter 12 the driver handle is inserted from to be seated within the third socket 62, either the through hole 20 associated with the first socket 40 or the through hole 20 associated with the second socket 52 will remain unblocked and available to receive a torque lever to assist in driving the driver adapter 12, the driver in operation with the driver adapter, and any fasteners being driven by these.

Figure 6:
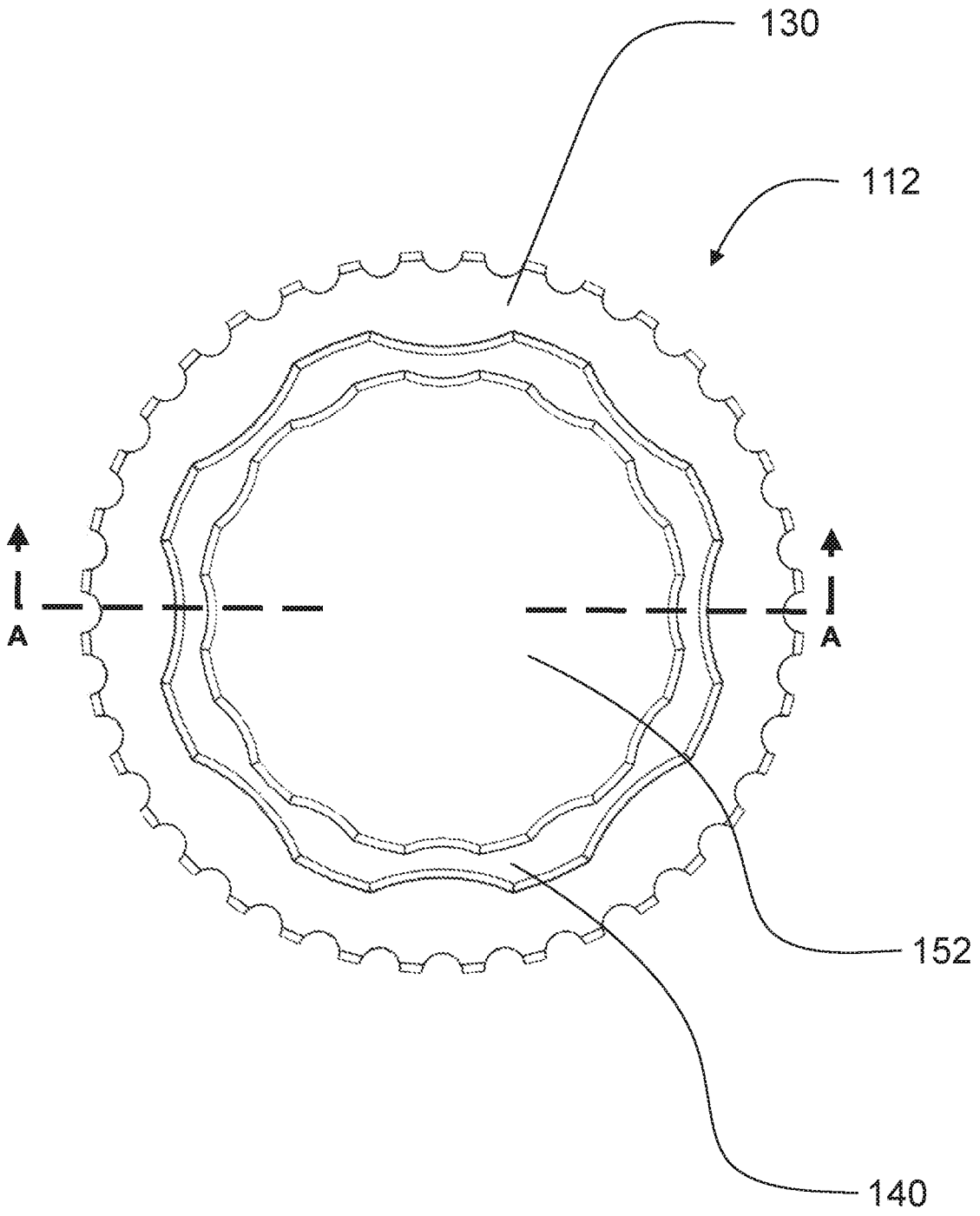
FIG. 6 illustrates an end view of a first end of a driver adapter in accordance with an example of the present disclosure.
Figure 7:
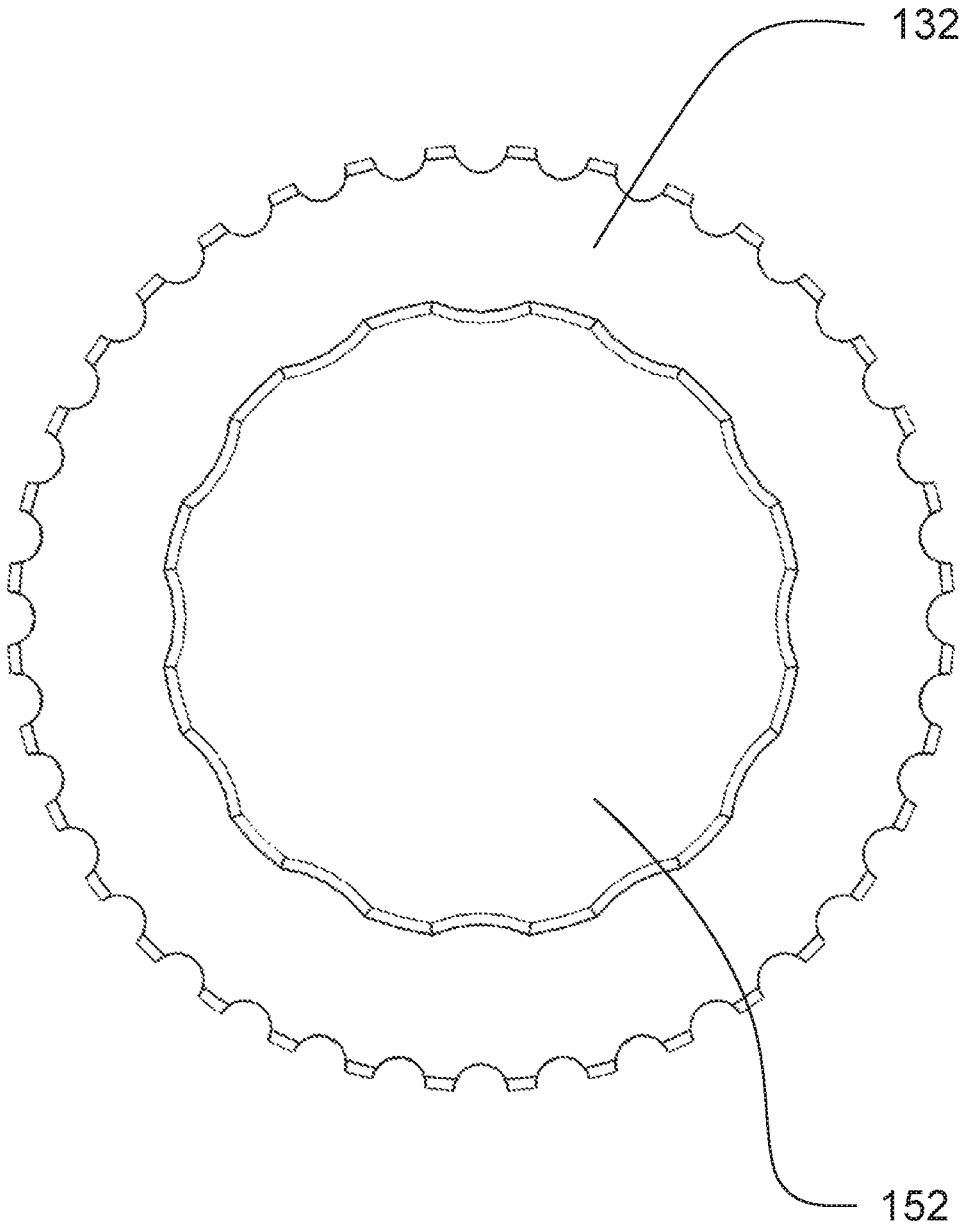
FIG. 7 illustrates an end view of a second end of the driver adapter of FIG. 6.
Figure 8:
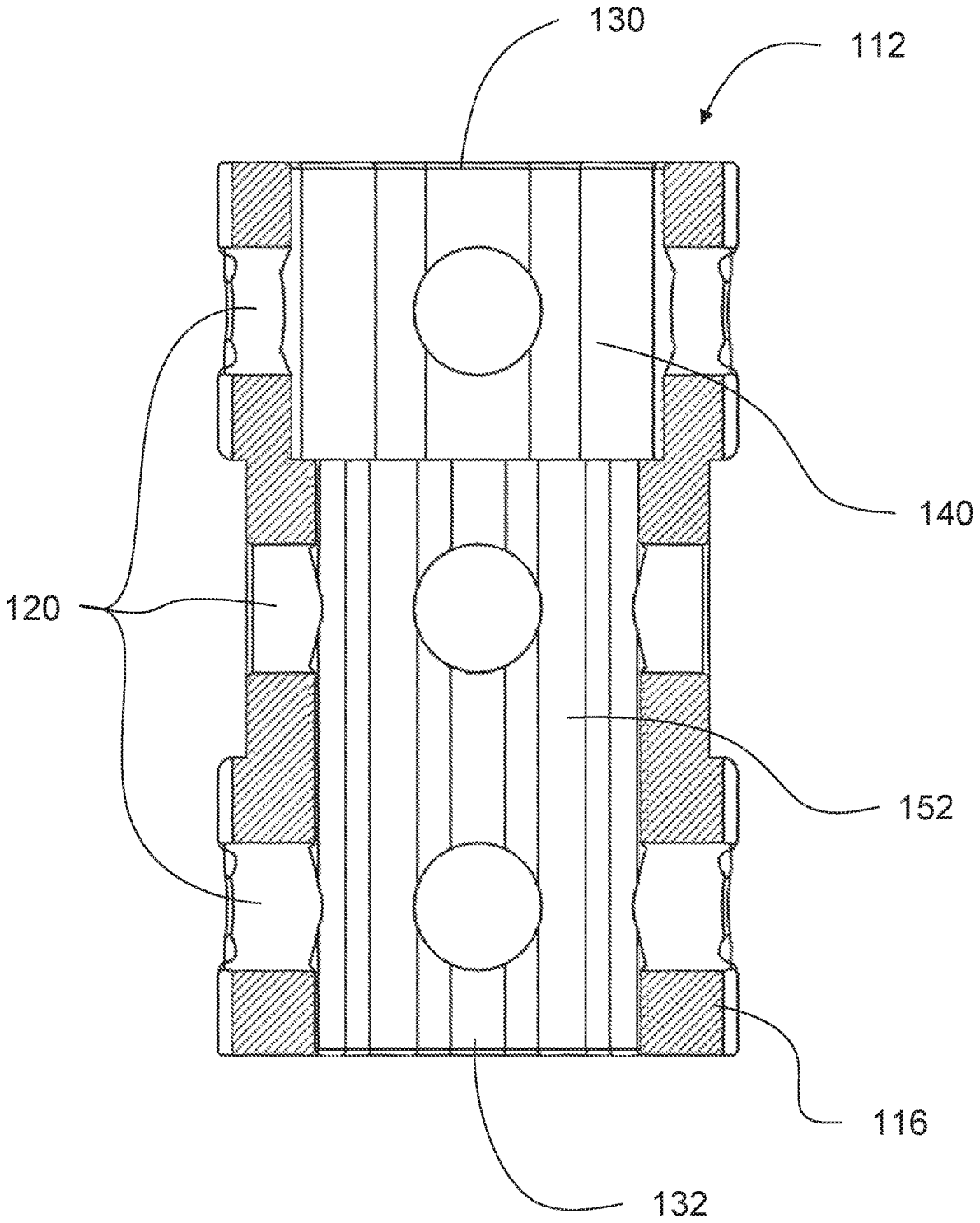
FIG. 8 illustrates a cross-sectional view of the driver adapter of FIG. 6, taken along lines AA of FIG. 6, the driver adapter comprising two sockets.

FIGS. 6-8 illustrate an example driver adapter 112 having an alternative configuration of sockets as compared to the driver adapter shown in FIGS. 1-5. The driver adapter 112 is similar in many respects to the driver adapter 12 discussed above and shown in FIGS. 1-5. Indeed, the driver adapter 112 can comprise many similar elements and features, and can function in a similar manner as the driver adapter 12 of FIGS. 1-5. As such, the discussion above is incorporated here where applicable with an understanding that driver adapter 112 differs from the driver adapter 12 as discussed below, and as will be appreciated by those skilled in the art. In this example, the driver adapter 112 can be part of a hand held tool system (e.g., the hand held tool system 10 of FIG. 1) as it is operable with a plurality of drivers (e.g., the first and second drivers 14 and 28 shown in FIG. 1) as well as a torque lever (e.g., the torque lever 22 shown in FIG. 1). As shown, the driver adapter 112 can comprise an elongate body 116 having a first end 130, a second end 132, and a plurality of through holes 120. However, the driver adapter 112 shown in FIGS. 6-8 comprises two sockets, unlike the example driver adapter 12 shown in FIGS. 1-5 which includes a third socket. A first socket 140 is at least partially formed within the elongate body 116 at the first end 130, and a second socket 152 is formed in the elongate body 116 at the second end 132. The second socket 152 is shown as comprising a longer longitudinal length (or in other words a greater depth) than the first socket 140. With this longer length, the driver adapter 112 is able to receive a greater portion of a driver handle of a driver, which can be beneficial in the event that the driver adapter 112 is needed for torqueing operations involving higher amounts of needed torque than those where the first socket 140 is used. By receiving a greater portion of the driver handle of the inserted driver, the forces exerted between the driver handle and the surfaces defining second socket 152 of the driver adapter 112 during a torqueing operation are distributed across a greater amount of surface area as compared with the force distribution achieved by the configuration of the first socket 140, and the forces that are present between the driver handle of a driver inserted into the first socket 140 and the surfaces defining the first socket 140 during a torqueing operation. Increasing the length (or depth) of a socket to effectively distribute forces applied during a torqueing operation over a larger or greater amount of surface area of the driver handle can lessen the shear forces acting on any particular portion of the driver handle as applied by the driver adapter, thus allowing the driver to be torqued to a greater magnitude while lessening the potential of damaging the driver. As shown in FIG. 8, the second socket 152 can extend to the first socket 140 such that first and second sockets are juxtaposed to one another. Moreover, a through passage can be formed through the elongate body 116, extending from the first end 130 to the second end 132 through the first and second sockets 140 and 152, respectively.

Figure 9:
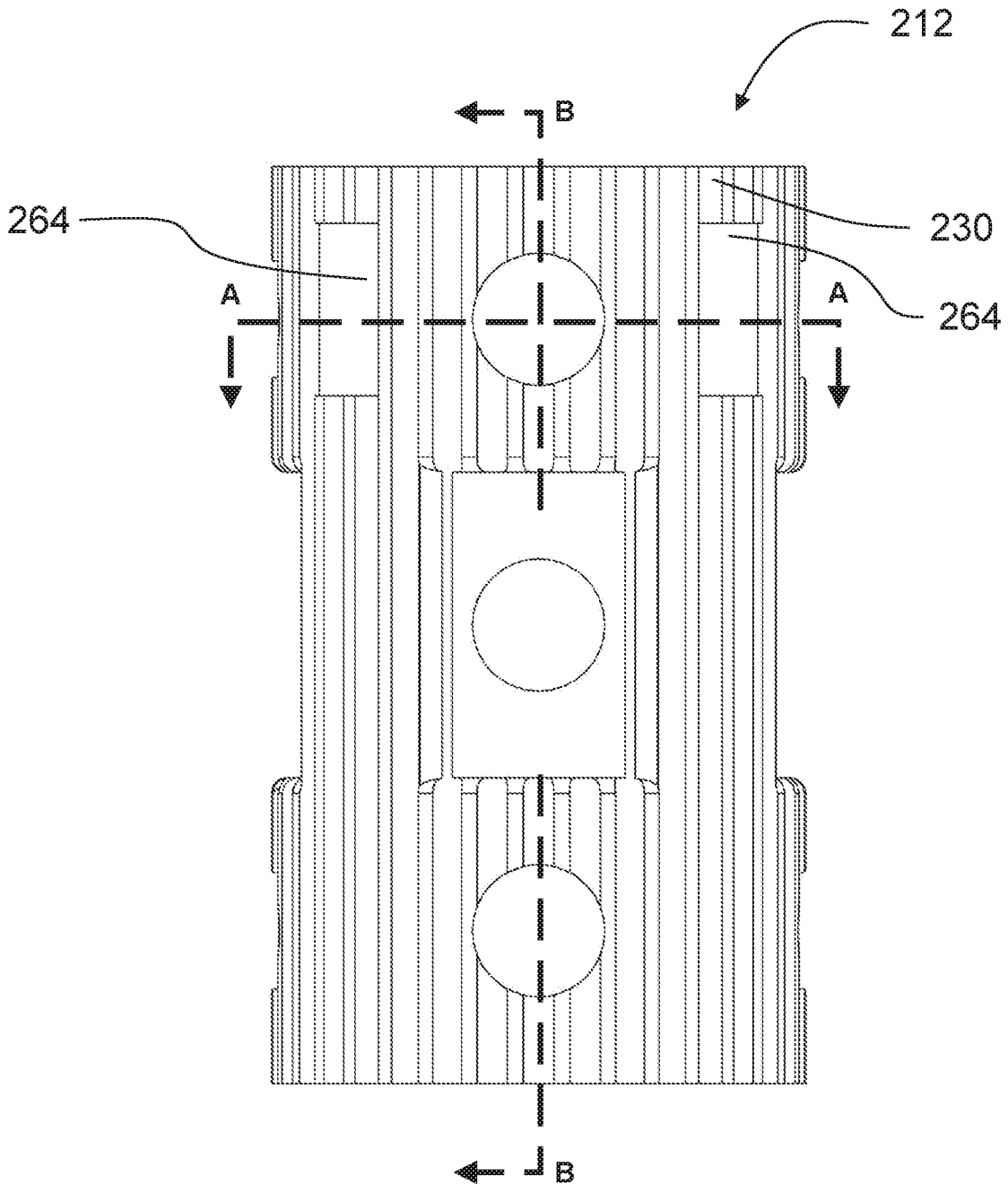
FIG. 9 illustrates a side view of a driver adapter having three sockets, in accordance with an example of the present disclosure.

FIG. 9 illustrates a driver adapter 212 in accordance with another example of the present disclosure. Driver adapter 212 comprises an elongate body 216 having a first end 230 configured similar to the first end of the example driver adapter shown in FIGS. 1-5, with the exception that a first socket, such as first socket 240 of FIG. 13, of the driver adapter 212 comprises a different internal configuration, and the first end 230 further comprises access holes 264 formed in the elongate body 216 proximate the first socket that are associated with the first socket. The access holes 264 can provide access to a driver handle of a driver inserted within the first socket by a gripping component, such as a flexible strap inserted into the access holes 264 and operable to wrap around the driver handle of the inserted driver. The gripping component can facilitate the gripping of a driver handle inserted into the first socket that would otherwise be too small to receive a transfer of torque from the driver adapter 212 to the driver handle. For example, as will be described in greater detail with reference to FIGS. 10-11, a flexible strap may be inserted through an access hole 264, routed around a driver handle, and fed back through and out of the access hole 264, or a different access hole in the event of a plurality of access holes formed in the elongate body 216. Upon rotating the driver adapter 212 relative to the driver handle, the flexible strap can be tensioned around the driver handle, gripping the driver handle tighter as tension in the strap is increased. Still further rotation of the driver adapter 212 relative to the driver handle 283 will further tension the flexible strap gripping the driver handle tighter (e.g., with greater compression or clamping forces) until the driver handle rotates with the driver adapter, thus transferring torque from the driver adapter 212 to the driver handle and the driver, and ultimately to the fastener being driven.

Figure 10:
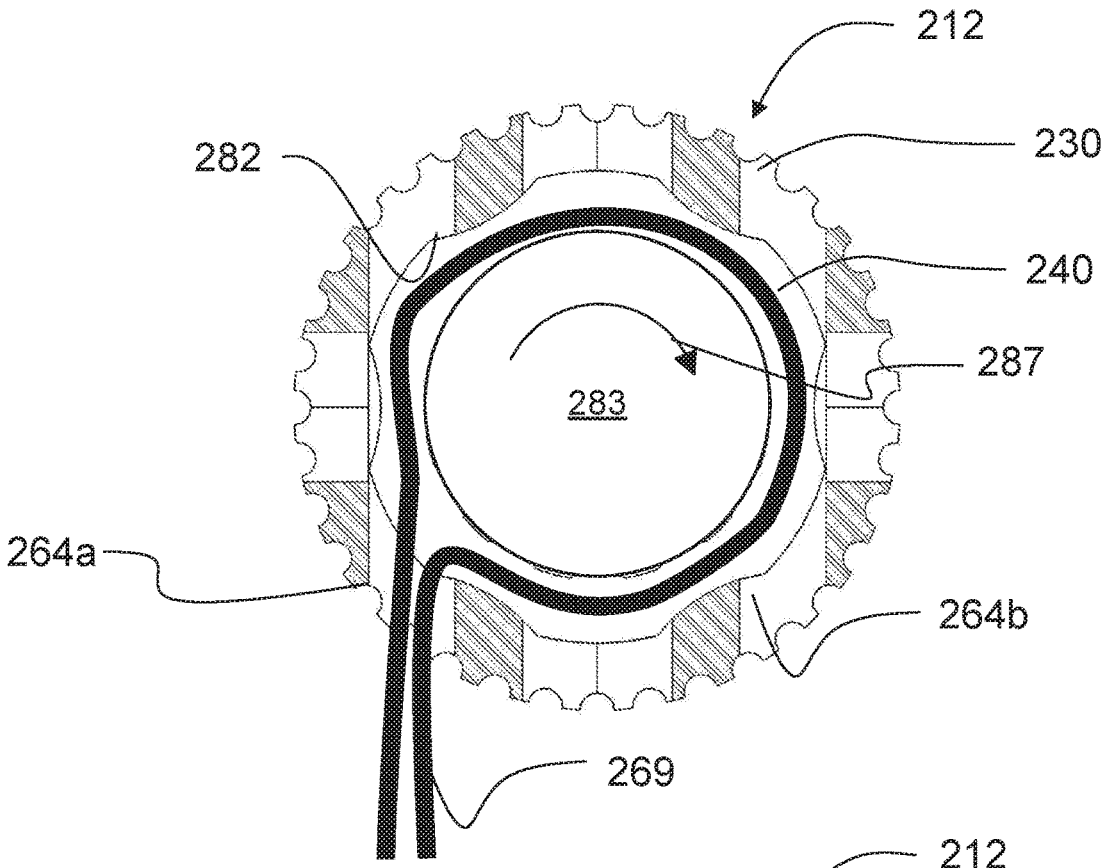
FIG. 10 illustrates a cross-sectional view of a first end of the driver adapter of FIG. 9 taken along line AA of FIG. 9, FIG. 10 further illustrating a portion of a torque lever in the form of a flexible strap operable with the driver adapter and shown as being wrapped around a driver handle of a driver inserted into the driver adapter from the first end.

This concept is illustrated in FIGS. 10-13. Specifically, the driver adapter 212 of FIG. 9 is shown having an access hole 264*a* associated with the first socket 240, and the flexible strap 269 passing through the access hole 264*a*, into the first socket 240 of the driver adapter 212, and around a driver handle 283 in a clockwise direction as shown by arrow 287. FIG. 10 illustrates the flexible strap 269 in position around the driver handle 283, but in a relaxed, unclamped state. The axis hole 264 is cut substantially tangential to a lateral surface 282 of the first socket. The flexible strap 269 is inserted into the first socket 240 through the access hole 264*a* in a tangential direction, routed around the driver handle 283, and through the access hole 264*a* in a substantially radial direction, curving abruptly to the tangential direction as it passes through the access hole 264*a*.

Figure 11:
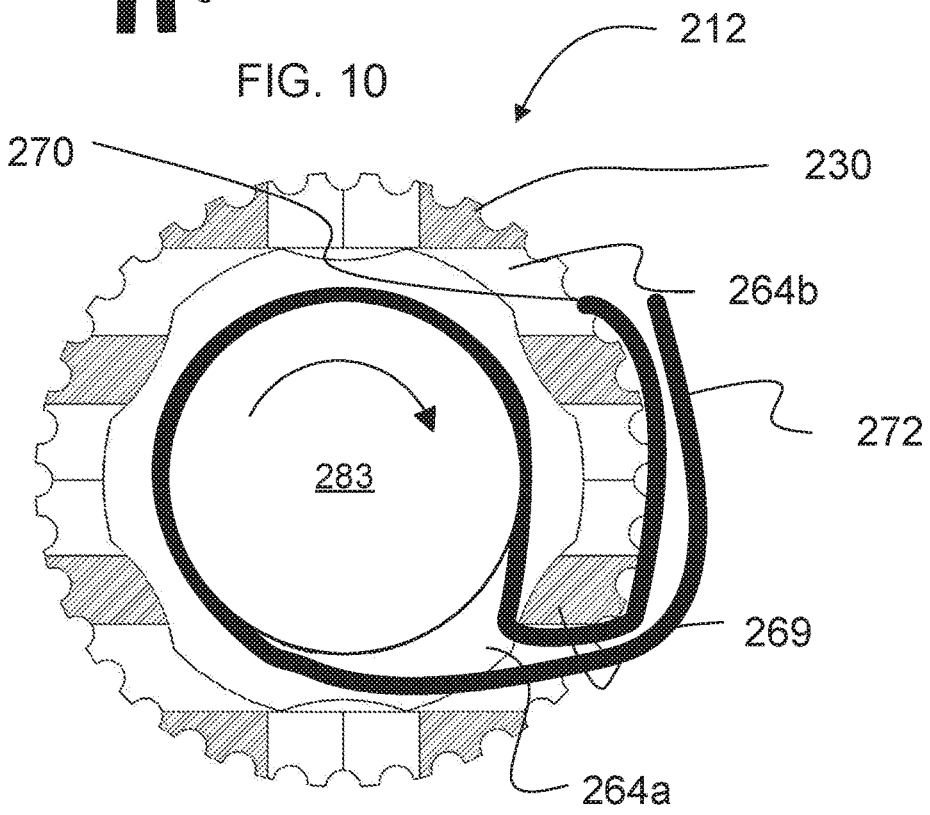
FIG. 11 illustrates a cross-sectional view of the first end of the driver adapter of FIG. 9 taken along line AA of FIG. 9, with the flexible strap being shown more tightly wrapped around the driver handle of the driver inserted into the driver adapter.

FIG. 11 illustrates the driver adapter 212 with the flexible strap 269 in a tensioned state, clamping the driver handle 283. In FIG. 11, a first end 270 of the flexible strap 269 is secured to the driver adapter 212. In some examples, the first end 270 may be secured to the driver adapter 212 by inserting it into access hole 264*b*. A second end 272 of the flexible strap 269 is pulled from the access hole 264*a* to take up any slack around the driver handle 283 and to tension the flexible strap 269. The tension is maintained on the flexible strap 269 and the driver adapter 212 is turned in a clockwise direction relative to the driver handle 283. The abrupt curve of the flexible strap 269 facilitates the securement of the first end 270 of the flexible strap 269 while the tangential path of the second end 272 of the flexible strap 269 allows the second end 272 to stretch as the driver adapter 212 rotates relative to the driver handle 283. As the flexible strap 269 stretches, the tension in the flexible strap 269 increases, gripping the driver handle 283 tighter until rotation of the driver handle 283 is coupled to rotation of the driver adapter 212, thereby facilitating a transfer of torque from the driver adapter 212 to the driver handle 283.

Figure 12:
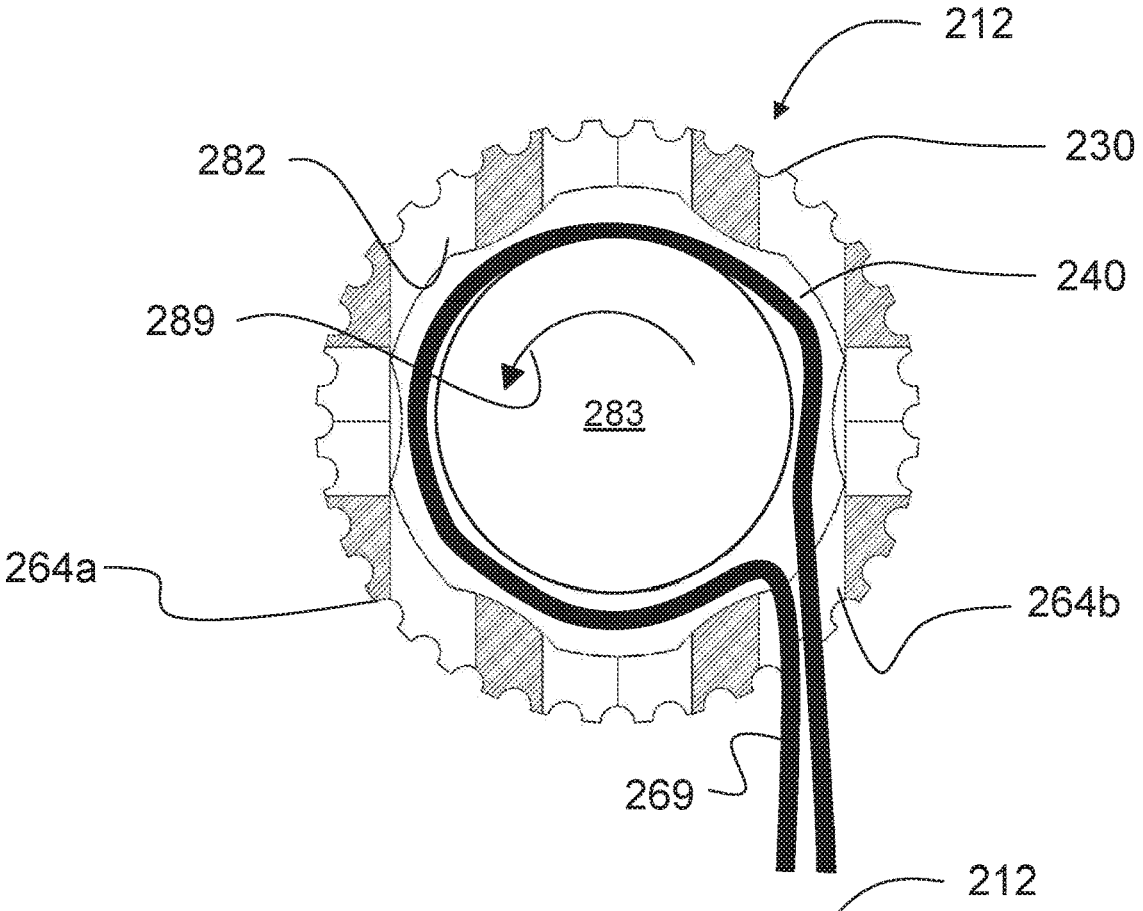
FIG. 12 illustrates a cross-sectional view of a first end of the driver adapter of FIG. 9 taken along line AA of FIG. 9, FIG. 10 further illustrating a portion of a torque lever in the form of a flexible strap operable with the driver adapter and shown as being wrapped around a driver handle of a driver inserted into the driver adapter from the first end.

FIG. 12 illustrates the driver adapter 212 of FIG. 9 having an access hole 264*b* associated with the first socket 240, and the flexible strap 269 passing through the access hole 264*b*, into the first socket 240 of the driver adapter 212, and around a driver handle 283 in a counterclockwise direction. As shown, the flexible strap 269 is in position around the driver handle 283, but in a relaxed, unclamped state. The flexible strap 269 is inserted into the access hole 264*b* in a tangential direction, routed around the driver handle 283 in a counterclockwise direction indicated by arrow 289, and through the access hole 264*b* in a substantially radial direction curving abruptly to a substantially tangential direction as it passes through the access hole 264*b*.

Figure 13:
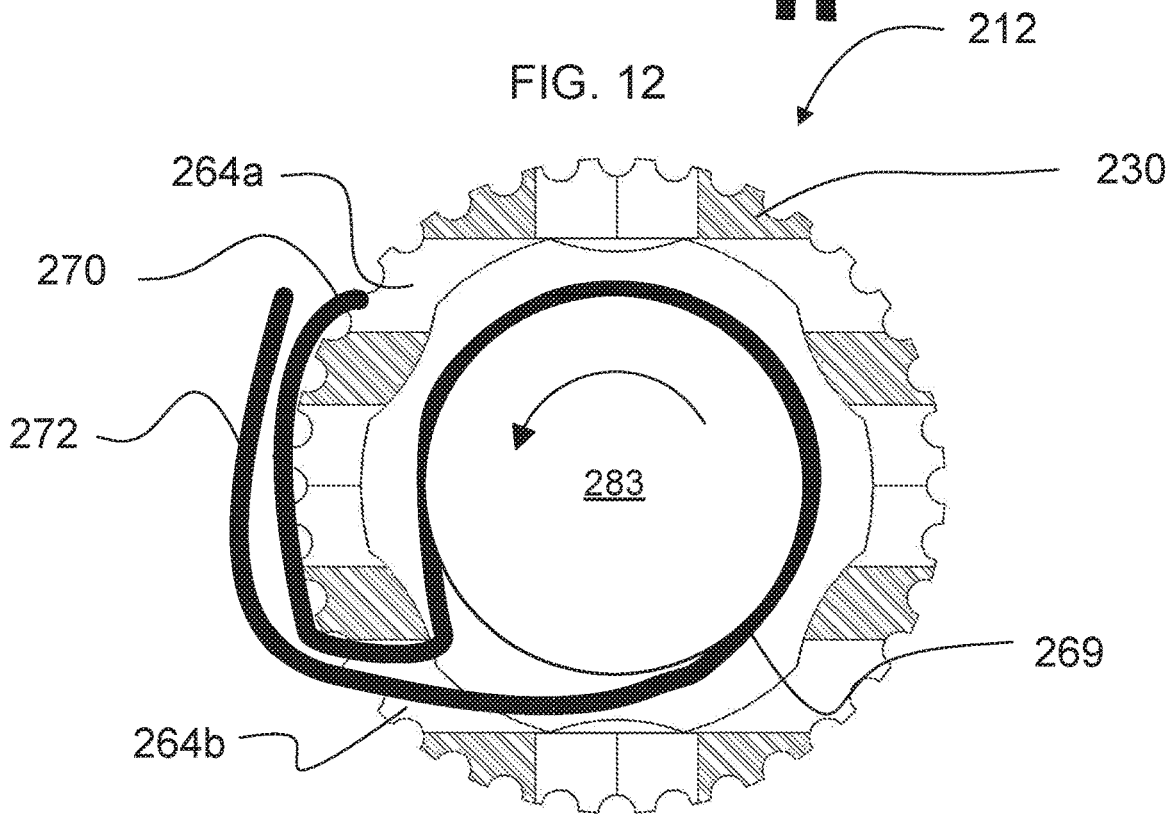
FIG. 13 illustrates a cross-sectional view of the first end of the driver adapter of FIG. 9 taken along line AA of FIG. 9, with the flexible strap being shown more tightly wrapped around the driver handle of the driver inserted into the driver adapter.

FIG. 13 illustrates the driver adapter 212 in a tensioned state, clamping the driver handle 283. In FIG. 13, a first end 270 of the flexible strap 269 is secured to the driver adapter 212. In some examples, the first end 270 may be secured to the driver adapter 212 by inserting it into access the hole 264*a*. A second end 272 of the flexible strap 269 is pulled from the access hole 264*a* to take up any slack around the driver handle 283 and to tension the flexible strap 269. The tension is maintained on the flexible strap 269 and the driver adapter 212 is turned in a clockwise direction relative to the driver handle 283. The abrupt curve of the flexible strap 269 facilitates the securement of the first end 270 of the flexible strap 269 to the driver adapter 212 while the tangential path of the second end 272 of the flexible strap 269 allows the second end 272 of the flexible strap 269 to stretch as the driver adapter 212 rotates relative to the driver handle 283. As the flexible strap 269 stretches, the tension in the flexible strap 269 increases, gripping the driver handle 283 tighter until movement of the driver handle 283 is coupled to movement of the driver adapter 212 thereby facilitating a transfer of torque from the driver adapter 212 to the driver handle 283.

Using a gripping component, such as the flexible strap 269, the first socket 240 of the driver adapter 212 can receive drivers of different size and configuration (the driver adapter 212 can be a universal driver adapter configured to function with different sized drivers in the same socket), even those that have a driver handle having a major diameter less than a major diameter of the first socket 240 of the driver adapter 212. For example, upon inserting a driver into the first socket 240 in which the driver has a driver handle that is too small to engage the walls of the first socket 240 in at least a three point contact arrangement, a gripping member, such as flexible strap 269 described above can be used to secure the driver within the first socket 240 and facilitate a transfer of torque from the driver adapter 212 to the driver handle.

The flexible strap 269 can comprise any type of flexible material or combination of flexible materials. For example, and not to be limiting in any way, the flexible strap 269 can comprise a flexible wire, a flexible rope, a flexible cable, a flexible polymer (plastic) band, a fabric strap, or any other type of flexible material or combination of materials having sufficient tensile strength so as to be able to exert a clamping force on a driver within the driver adapter 212 sufficient to effectuate a transfer of torque from the driver adapter 212 to the driver, as discussed herein, and as will be apparent to those skilled in the art.

Using a flexible strap, such as the flexible strap 269 shown, the first socket 240 of the driver adapter 212 can receive drivers of different size and configuration (the driver adapter 212 can be a universal driver adapter configured to function with different sized drivers in the same socket), even those that have a driver handle having a major diameter less than a major diameter of the first socket 240 of the driver adapter 212. For example, upon inserting a driver into the first socket 240 in which the driver has a driver handle that is too small to engage the walls of the first socket 240 in at least a three point contact arrangement, the flexible strap 269 described above can be used to secure the driver within the first socket 240. Moreover, the flexible strap 269 can function to reduce any torque error that may be caused by the driver not being centered within the first socket 240 due to the small size of the driver handle relative to the size of the first socket 240 because the flexible strap 269 can secure the driver against the walls of the first socket 240 with a sufficient amount of clamping force, such that the flexible strap 269 prevents the driver from moving relative to the driver adapter 212, thus facilitating the transfer of torque to the driver upon rotation of the driver adapter 212.

Figure 14:
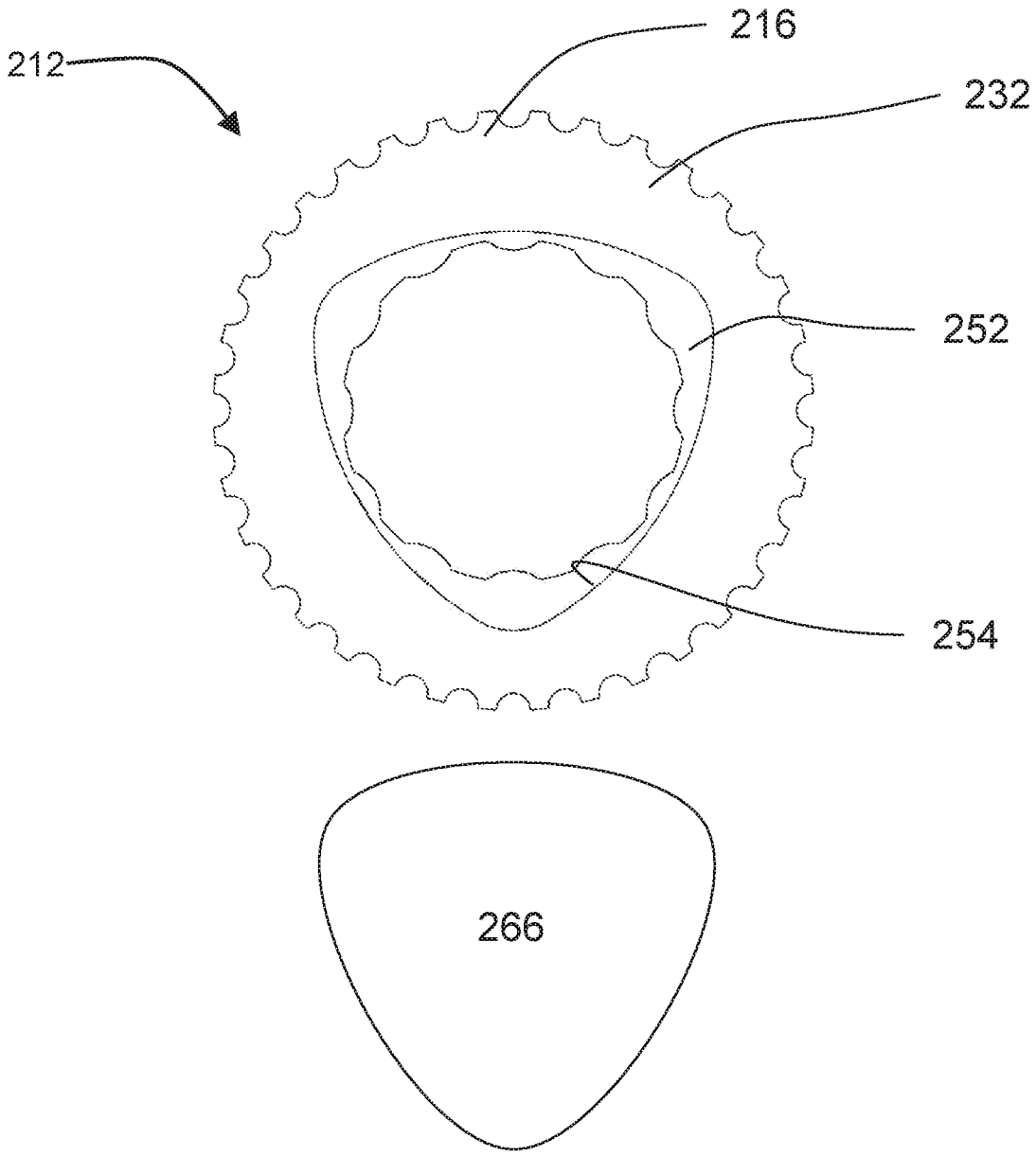
FIG. 14 illustrates an end view of a second end of the driver adapter of FIG. 9, further illustrating a cross-sectional profile of a driver configured for insertion into the driver adapter from the second end.

FIG. 14 illustrates the second end 232 of the driver adapter 212 showing an alternative configuration of the second socket 252. In this example, the second socket 252 comprises socket walls 254 defining an internal configuration having a generally triangular shape suitable for use with a driver handle 266 having a generally triangular profile.

Figure 15:
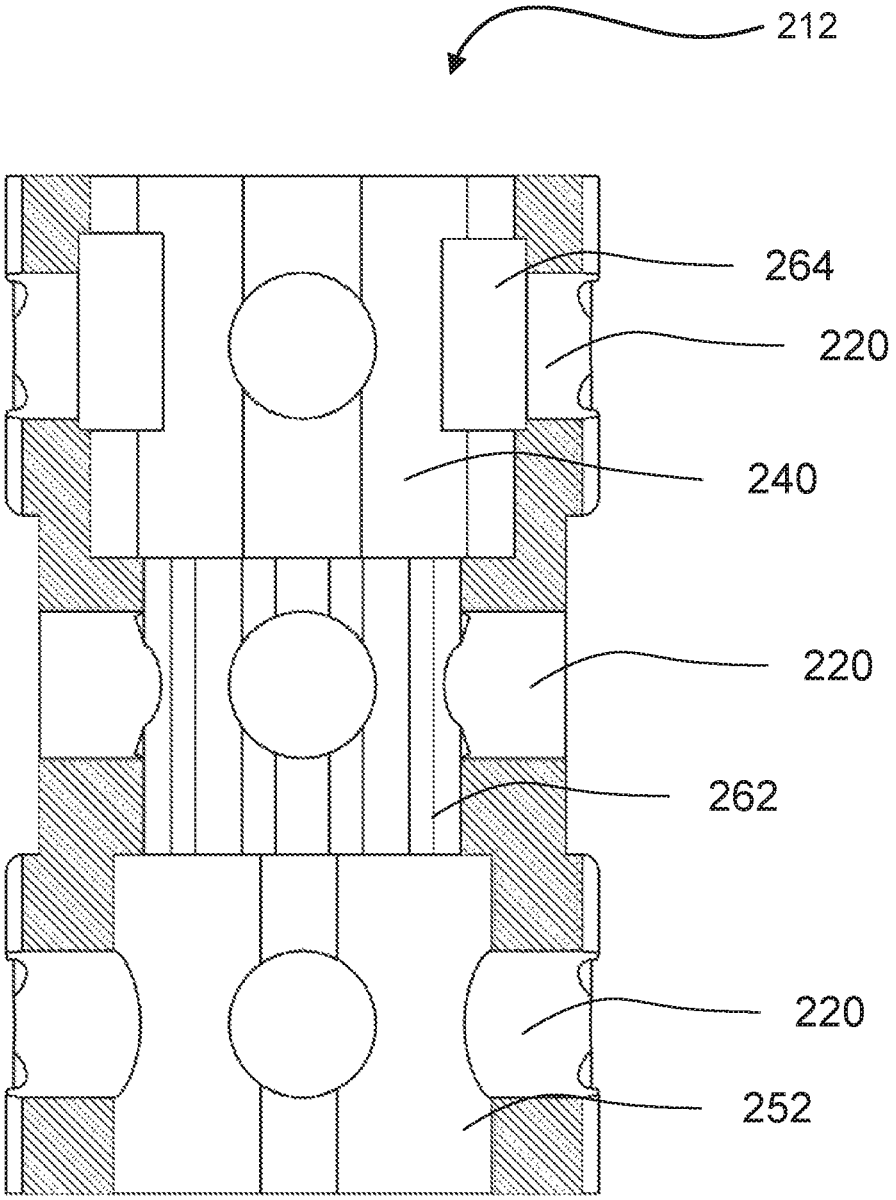
FIG. 15 illustrates a cross-sectional view of the driver adapter of FIG. 9, taken along lines BB of FIG. 9.

FIG. 15 illustrates cross section of the elongate body 216 of FIG. 9 taken about line BB of FIG. 9. As shown, the driver adapter 212 comprises three sockets, namely first socket 240, second socket 252, and third socket 262, similar in form to, and that function as, those discussed above. The driver adapter 212 further comprises a plurality of through holes 220, and access holes 264, also similar in form to, and that function as, those discussed above, FIG. 16 illustrates an alternative internal configuration of a socket 384 of an example driver adapter 312 and an example of a driver handle 372. In this example, the socket 384 has an internal configuration comprising a plurality of flats 370. The corresponding driver handle 372 can have a profile with an external configuration having a plurality of flats 374. The socket 384 may be positioned over the driver handle 372, such that the flats 370 of the socket 384 interface with the flats 374 of the driver handle 372 coupling rotation between the driver adapter 312 and the driver handle 372. The size of the socket 384 may be slightly larger than the size of the driver handle 372 to allow the driver adapter 312 to slide over the driver handle 372.

Figure 16:
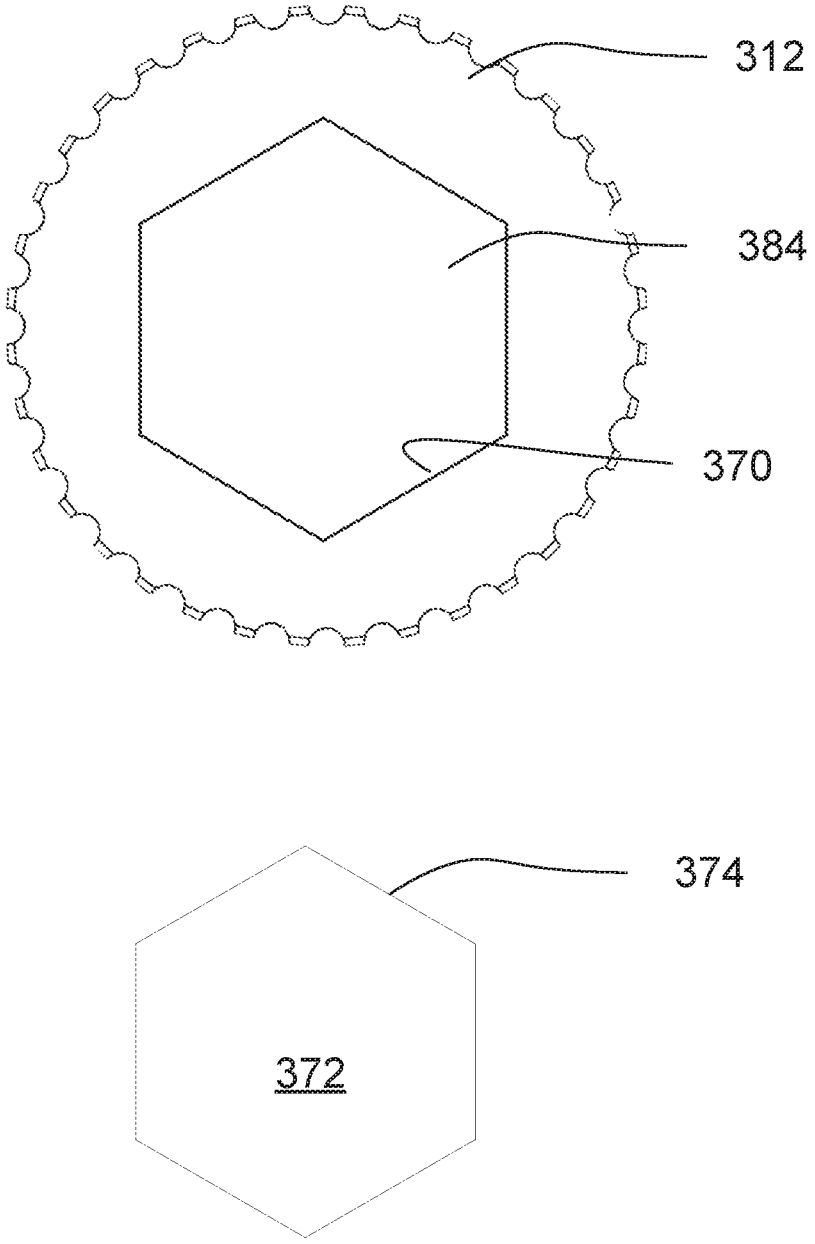
FIG. 16 illustrates an end view of a driver adapter in accordance with another example of the present disclosure, with the corresponding socket having a hexagonal cross-sectional configuration.
Figure 17:
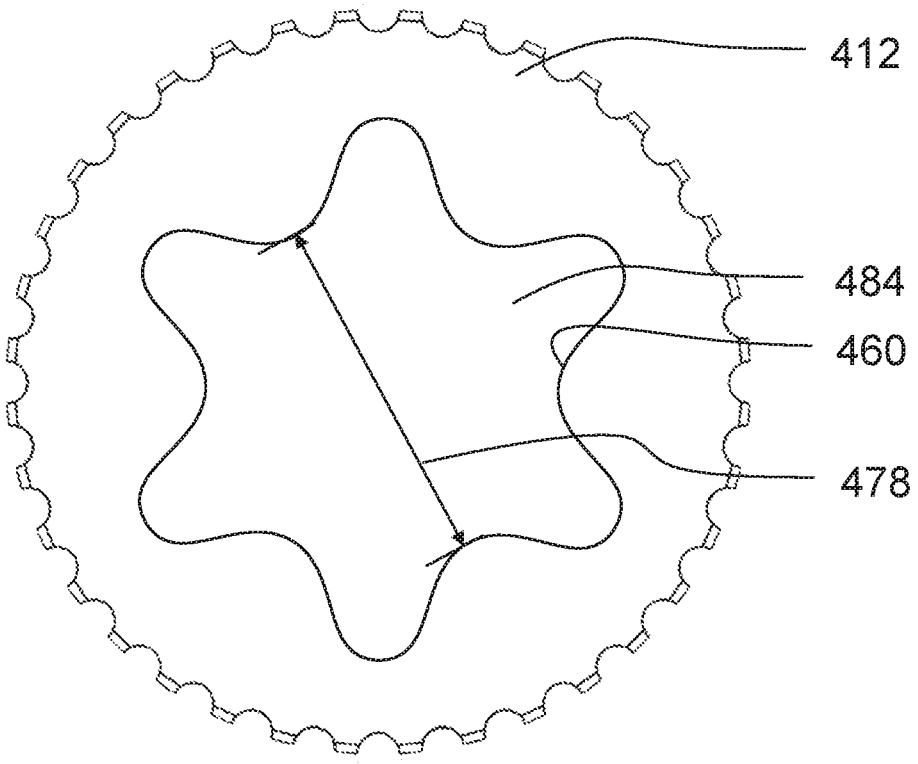
FIG. 17 illustrates an end view of a driver adapter in accordance with another example of the present disclosure, with the corresponding socket having a star-shaped cross-sectional configuration.
Figure 17:
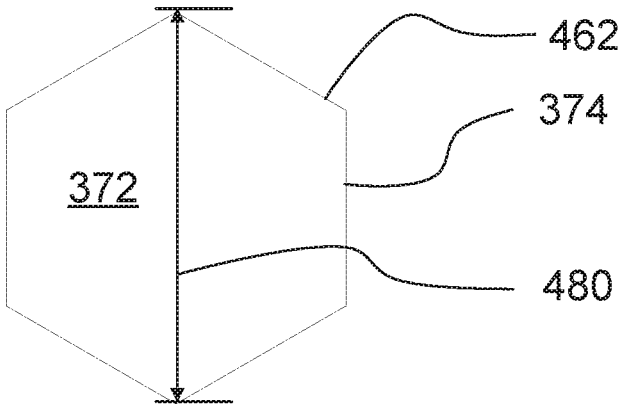

FIG. 17 illustrates an alternative internal configuration of a socket 484 of an example driver adapter 412 and the example of a driver handle 372 of FIG. 16. In this example, the driver adapter 412 may be used to interface with the driver handle 372 to achieve at least a three-point contact, in which the driver handle 372 comprises a plurality of flats 374. A minor diameter 478 of the socket 484 is less than a major diameter 480 of the driver handle 372. Thus, a lateral surface 460 of the socket 484 can engage a lateral surface 462 of the driver handle 372 as the driver adapter 412 is rotated. When the lateral surface 460 of the socket 484 engages the lateral surface 462 of the driver handle 372, driver adapter 412 can transfer torque to the driver handle 372, despite the socket 484 having an internal configuration that is different in configuration than the profile of the driver handle 372.

The previously described driver adapters may be configured by forming a first socket in a first end of an elongate body, forming a second socket in a second end of the elongate body spaced longitudinally from the first end, and forming a plurality of through holes formed through and distributed longitudinally along a length of the elongate body between the first end and the second end. The elongate body can comprise a material such as a polymer, metal, composite, or others. In some examples, the elongate body can be formed using three-dimensional printing or other additive manufacturing techniques.

The first socket can be formed with an internal configuration sized and shaped to fit a handle of a first driver and to transfer torque to the first driver upon rotation of the driver adapter. The second socket can be formed to have an internal configuration sized and shaped to fit a handle of a second driver. The plurality of through holes can be formed to have a size and configuration to receive a torque lever that facilitates rotation of the driver adapter. In some examples, the size and the configuration of the sockets formed may correspond to the previously described examples.

It is to be understood that the examples set forth herein are not limited to the particular structures, process steps, or materials disclosed, but are extended to equivalents thereof as would be recognized by those ordinarily skilled in the relevant arts. It should also be understood that terminology employed herein is used for the purpose of describing particular examples only and is not intended to be limiting.

Furthermore, the described features, structures, or characteristics may be combined in any suitable manner in one or more examples. In the description, numerous specific details are provided, such as examples of lengths, widths, shapes, etc., to provide a thorough understanding of the technology being described. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the invention in one or more particular applications, it will be apparent to those of ordinary skill in the art that numerous modifications in form, usage and details of implementation can be made without the exercise of inventive faculty, and without departing from the principles and concepts described herein. Accordingly, it is not intended that the invention be limited, except as by the claims set forth below.

What is claimed is:

1. A driver adapter for use with a driver handle of a driver, and operable to transfer torque to the driver, the driver adapter, comprising:

an elongate body having a first end and a second end spaced longitudinally apart from the first end;

a first socket formed in the first end, the first socket having an internal configuration sized and shaped to receive a driver handle of a first driver, and to transfer torque to the first driver upon rotation of the driver adapter;

a second socket formed in the second end, the second socket having an internal configuration sized and shaped to receive a driver handle of a second driver, and to transfer torque to the second driver upon rotation of the driver adapter;

a third socket formed in the elongate body between the first and second sockets, the third socket having a third configuration sized and shaped to receive a driver handle of a third driver, wherein the third socket extends from the first socket to the second socket so that the third socket is accessible from both the first end and the second end; and a plurality of through holes formed through and distributed longitudinally along a length of the elongate body between the first end and the second end, the plurality of through holes sized and configured to receive a torque lever that facilitates rotation of the driver adapter.

2. The driver adapter of claim 1, wherein the first socket is different in size from the second socket, such that the driver adapter is operable with the first and second drivers having driver handles of different size.

3. The driver adapter of claim 1, wherein the internal configuration of the first socket is different from the internal configuration of the second socket, such that the driver is operable with the first and second drivers being of different types, and having driver handles of different configuration.

4. The driver adapter of claim 1, wherein the internal configuration of the first socket has a first pattern of first protrusions and the internal configuration of the second socket has a second pattern of second protrusions.

5. The driver adapter of claim 1, wherein the internal configuration of the first socket has a first pattern of flats and the internal configuration of the second socket has a second pattern of flats.

6. The driver adapter of claim 1, wherein the internal configuration of the first socket has a pattern of flats and the internal configuration of the second socket has a pattern of protrusions.

7. The driver adapter of claim 4, wherein at least one of the first pattern of protrusions or the second pattern of protrusions is sized and shaped to complement a flute of a driver handle.

8. The driver adapter of claim 2, wherein a minor diameter of the internal configuration of the first socket is greater than a major diameter of the internal configuration of the second socket.

9. The driver adapter of claim 1, wherein the third socket comprises a major diameter less than a minor diameter of the first configuration of the first socket and a minor diameter of the second configuration of the second socket.

10. The driver adapter of claim 1, further comprising a torque lever extending through a through hole of the plurality of through holes.

11. The driver adapter of claim 1, wherein the torque lever comprises a rigid rod.

12. The driver adapter of claim 11, wherein the rigid rod extends through a through holes of the plurality of through holes, such that the rigid rod extends in opposing directions from the driver adapter.

13. The driver adapter of claim 11, wherein the torque lever comprises a flexible strap extending through a through hole of the plurality of through holes.

14. A hand tool system comprising:

a first driver comprising a driver handle having a first external configuration and a driver component secured to the driver handle;

a second driver comprising a driver handle having a second external configuration and a driver component secured to the driver handle;

a third driver comprising a driver handle having a third external configuration and a driver component secured to the driver handle;

a driver adapter selectively fittable over the driver handles of the first, second, and third drivers, the driver adapter comprising:

an elongate body having a longitudinal axis, a first end, and a second end spaced longitudinally apart from the first end;

a first socket formed in the first end, the first socket having an internal configuration sized and shaped to receive the driver handle of the first driver, and to transfer torque to the first driver upon rotation of the driver adapter;

a second socket formed in the second end, the second socket having an internal configuration sized and shaped to receive the driver handle of the second driver, and to transfer torque to the second driver upon rotation of the driver adapter;

a third socket formed in the elongate body between the first and second sockets, the third socket having a third configuration sized and shaped to receive a driver handle of a third driver, wherein the third socket extends from the first socket to the second socket so that the third socket is accessible from both the first end and the second end; and a plurality of through holes formed through and distributed longitudinally along a length of the elongate body between the first end and the second end, the plurality of through holes sized and configured to receive a torque lever that facilitates rotation of the driver adapter.

15. The hand tool system of claim 14, further comprising a torque lever disposed in a hole of the plurality of through holes.

16. The hand tool system of claim 15, wherein the torque lever comprises a flexible strap extending through a through hole of the plurality of through holes.

17. The hand tool system of claim 14, wherein the first external configuration of the driver handle of the first driver has a plurality of flutes, and the internal configuration of the first socket of the driver adapter has a plurality of protrusions configured to extend into the plurality of flutes.

18. The hand tool system of claim 14, wherein the first external configuration of the driver handle of the first driver has a first plurality of flats, and the internal configuration of the first socket of the driver adapter has a second plurality of flats configured to interface with the first plurality of flats.

19. The hand tool system of claim 14, wherein the first socket is different in size from the second socket, such that the driver adapter is operable with the first and second drivers having driver handles of different size.

20. The hand tool system of claim 14, wherein the internal configuration of the first socket is different from the internal configuration of the second socket, such that the driver is operable with the first and second drivers being of different types, and having driver handles of different configuration.

21. A method for configuring a driver adapter, comprising:

forming a first socket in a first end of an elongate body, the first socket having an internal configuration sized and shaped to fit a handle of a first driver and to transfer torque to the first driver upon rotation of the driver adapter;

forming a second socket in a second end of the elongate body, the second end spaced longitudinally from the first end and the second socket having an internal configuration sized and shaped to fit a handle of a second driver; and forming a third socket in the elongate body between the first and second sockets, the third socket having a third configuration sized and shaped to receive a driver handle of a third driver, wherein the third socket extends from the first socket to the second socket so that the third socket is accessible from both the first end and the second end;

forming a plurality of through holes formed through and distributed longitudinally along a length of the elongate body between the first end and the second end, the plurality of through holes sized and configured to receive a torque lever that facilitate rotation of the driver adapter.

22. The method for configuring a driver adapter of claim 21, further comprising forming the internal configuration of the first socket with a first pattern of protrusions, and forming the internal configuration of the second socket with a second pattern of protrusions.

23. The method for configuring a driver adapter of claim 22, further comprising forming at least one of the first pattern of protrusions and the second pattern of protrusions with a size and shape to complement a flute of a driver handle.

24. The method for configuring a driver adapter of claim 21, further comprising forming the first socket to have a minor diameter of the internal configuration of the first socket greater than a minor diameter of the internal configuration of the second socket.

25. The method for configuring a driver adapter of claim 21, wherein the third socket comprises a major diameter less than a minor diameter of the first configuration and a minor diameter of the second configuration.

* * * * *